US010010738B2

(12) United States Patent
Gerschefske et al.

(10) Patent No.: US 10,010,738 B2
(45) **Date of Patent: *Jul. 3, 2018**

(54) EXERCISE APPARATUS WITH RESILIENT FOOT SUPPORT

(71) Applicant: STAMINA PRODUCTS, INC., Springfield, MO (US)

(72) Inventors: Kevin Gerschefske, Springfield, MO (US); Jack S. Barufka, Reston, VA (US)

(73) Assignee: STAMINA PRODUCTS, INC., Springfield, MO (US)

( * ) Notice: Subject to any disclaimer, the term of this patent is extended or adjusted under 35 U.S.C. 154(b) by 111 days.

This patent is subject to a terminal disclaimer.

(21) Appl. No.: 14/035,473

(22) Filed: Sep. 24, 2013

(65) Prior Publication Data

US 2014/0024509 A1 Jan. 23, 2014

Related U.S. Application Data

(60) Division of application No. 12/829,203, filed on Jul. 1, 2010, now Pat. No. 8,562,492, which is a (Continued)

(51) Int. Cl.
*A63B 21/068* (2006.01)
*A63B 21/04* (2006.01)
(Continued)

(52) U.S. Cl.
CPC ..... *A63B 21/04* (2013.01); *A63B 5/00* (2013.01); *A63B 5/11* (2013.01); *A63B 21/02* (2013.01);
(Continued)

(58) Field of Classification Search
USPC ..... 482/72, 77, 95, 96, 111, 121, 142
See application file for complete search history.

(56) References Cited

U.S. PATENT DOCUMENTS 339,638 A 4/1886 Goldie
1,996,350 A * 4/1935 Schaff ..... 482/96
(Continued)

OTHER PUBLICATIONS

Extended European Search Report, including the Search Opinion, as issued for European Patent Application No. 11164238.5, dated Jul. 3, 2012.

(Continued)

*Primary Examiner* — Andrew S Lo
*Assistant Examiner* — Shila Jalalzadeh Abyan
(74) *Attorney, Agent, or Firm* — Pillsbury Winthrop Shaw Pittman, LLP

(57) ABSTRACT

An exerciser including a movable body carriage mounted on an exerciser frame for movement along tracks provided by the frame. A resilient foot engaging assembly extends from the exerciser frame. The resilient foot engaging assembly is adapted to be engaged by the user's feet to absorb the energy of movement in a first direction and to provide the user with a bouncing movement, which the user may translate into a movement of the movable body carriage in the opposite direction. The resilient foot engaging assembly may be provided as an attachment and retrofitted to existing exercisers. The resilient foot engaging assembly includes a unit mounting frame assembly and an independent usable exercising unit, such as an inflated dome or trampoline unit, removably secured thereon. The exerciser may include a resilient resistance system coupled to the movable body carriage and a set of pull lines with user grips trained over pulleys carried by the exerciser frame. Also disclosed are methods for enabling users to exercise in either one of two different modes.

25 Claims, 21 Drawing Sheets

Related U.S. Application Data continuation of application No. 11/702,672, filed on Feb. 6, 2007, now Pat. No. 7,806,805, and a continuation of application No. 11/592,139, filed on Nov. 3, 2006, now Pat. No. 7,771,328, said application No. 11/702,672 is a continuation-in-part of application No. 10/693,443, filed on Oct. 27, 2003, now Pat. No. 7,179,207, said application No. 11/592,139 is a continuation of application No. 10/693,443.

(51) Int. Cl.

| | |
|---|---|
| ***A63B 5/00*** | (2006.01) |
| ***A63B 5/11*** | (2006.01) |
| ***A63B 21/055*** | (2006.01) |
| ***A63B 23/04*** | (2006.01) |
| *A63B 21/00* | (2006.01) |
| *A63B 21/02* | (2006.01) |
| *A63B 22/00* | (2006.01) |
| *A63B 23/035* | (2006.01) |

(52) U.S. Cl.

CPC ..... *A63B 21/055* (2013.01); *A63B 21/068* (2013.01); *A63B 22/0087* (2013.01); *A63B 23/0405* (2013.01); *A63B 21/00065* (2013.01); *A63B 21/023* (2013.01); *A63B 21/0428* (2013.01); *A63B 21/0442* (2013.01); *A63B 21/0557* (2013.01); *A63B 22/0023* (2013.01); *A63B 23/0355* (2013.01); *A63B 23/03575* (2013.01); *A63B 2208/0252* (2013.01); *A63B 2208/0257* (2013.01)

(56) References Cited

U.S. PATENT DOCUMENTS

| | | | | | |
|---|---|---|---|---|---|
| 3,256,021 | A | | 6/1966 | Nissen et al. | |
| 3,394,934 | A | | 7/1968 | Petros et al. | |
| 3,770,267 | A | | 11/1973 | McCarthy | |
| 3,837,643 | A | * | 9/1974 | Lee | A63B 5/11 482/29 |
| 4,077,623 | A | | 3/1978 | Clausell | |
| 4,272,074 | A | | 6/1981 | Sferle | |
| 4,340,216 | A | * | 7/1982 | Murphy | A61H 3/008 105/150 |
| 4,468,025 | A | | 8/1984 | Sferle | |
| 4,477,070 | A | | 10/1984 | Appelbaum | |
| 4,564,193 | A | * | 1/1986 | Stewart | A63B 17/00 482/102 |
| 4,685,669 | A | | 8/1987 | DeCloux | |
| 4,700,946 | A | | 10/1987 | Breunig | |
| 4,706,953 | A | | 11/1987 | Graham | |
| 4,722,520 | A | | 2/1988 | Lee | |
| 4,730,826 | A | * | 3/1988 | Sudmeier | A63B 5/11 482/28 |
| 4,796,882 | A | | 1/1989 | Jiumr | |
| 4,828,255 | A | | 5/1989 | Lahman | |
| 4,836,530 | A | | 6/1989 | Stanley, Jr. | |
| 4,884,802 | A | | 12/1989 | Graham | |
| 4,911,438 | A | | 3/1990 | Van Straaten | |
| 4,928,957 | A | | 5/1990 | Lanier et al. | |
| 4,974,840 | A | | 12/1990 | Welch | |
| 5,066,005 | A | * | 11/1991 | Luecke | A63B 21/4029 482/130 |
| 5,017,115 | A | | 12/1991 | Welch | |
| 5,071,115 | A | | 12/1991 | Welch | |
| 5,160,305 | A | | 11/1992 | Lin | |
| 5,169,363 | A | | 12/1992 | Campanaro et al. | |
| 5,215,511 | A | | 6/1993 | Cheng | |
| 5,312,315 | A | | 5/1994 | Mortensen et al. | |
| 5,338,278 | A | | 8/1994 | Endelman | |
| 5,364,327 | A | | 11/1994 | Graham | |
| 5,385,518 | A | | 1/1995 | Turner | |
| 5,445,583 | A | | 8/1995 | Habing | |
| D362,700 | S | | 9/1995 | Breibart et al. | |
| 5,451,093 | A | * | 9/1995 | Petrie et al. | 297/137 |
| 5,620,403 | A | | 4/1997 | Lundin | |
| 5,622,527 | A | | 4/1997 | Watterson et al. | |
| 5,634,870 | A | | 6/1997 | Wilkinson | |
| D382,319 | S | | 8/1997 | Gerschefske et al. | |
| 5,788,606 | A | * | 8/1998 | Rich | 482/27 |
| 5,792,033 | A | | 8/1998 | Merrithew | |
| 5,897,459 | A | | 4/1999 | Habing et al. | |
| 5,938,571 | A | * | 8/1999 | Stevens | 482/96 |
| 5,967,955 | A | * | 10/1999 | Westfall et al. | 482/142 |
| 6,010,434 | A | | 1/2000 | Hodges | |
| 6,042,523 | A | | 3/2000 | Graham | |
| 6,135,922 | A | | 10/2000 | Nissen | |
| 6,162,061 | A | * | 12/2000 | Taylor | 434/253 |
| 6,186,929 | B1 | | 2/2001 | Endelman et al. | |
| 6,206,809 | B1 | | 3/2001 | Habing et al. | |
| 6,280,367 | B1 | | 8/2001 | Arsenault | |
| 6,338,704 | B1 | | 1/2002 | Endelman | |
| 6,371,895 | B1 | | 4/2002 | Endelman et al. | |
| 6,422,983 | B1 | | 7/2002 | Weck | |
| 6,500,099 | B1 | | 12/2002 | Eschenbach | |
| 6,527,685 | B2 | | 3/2003 | Endelman et al. | |
| 6,547,701 | B1 | | 4/2003 | Eschenbach | |
| 6,551,219 | B1 | | 4/2003 | Brown | |
| 6,702,726 | B2 | | 3/2004 | Lin | |
| 6,752,745 | B1 | | 6/2004 | Davis | |
| 6,767,314 | B2 | | 7/2004 | Thompson | |
| 6,872,175 | B2 | * | 3/2005 | Lin | 482/146 |
| 7,115,077 | B2 | | 10/2006 | Yang | |
| 7,163,498 | B1 | * | 1/2007 | Abelbeck | A63B 21/4049 482/142 |
| 7,179,207 | B2 | | 2/2007 | Gerschefske | |
| 7,381,172 | B1 | | 6/2008 | Gehrke | |
| 7,637,854 | B2 | | 12/2009 | Jang | |
| 7,682,297 | B2 | | 3/2010 | Graham | |
| 7,771,328 | B2 | | 8/2010 | Gerschefske | |
| 7,806,805 | B2 | | 10/2010 | Barufka et al. | |
| 7,967,736 | B2 | | 6/2011 | D'Silva et al. | |
| 2002/0058573 | A1 | | 5/2002 | Endelman et al. | |
| 2002/0183172 | A1 | | 12/2002 | Chen | |
| 2003/0125163 | A1 | * | 7/2003 | Plante | 482/27 |
| 2003/0199372 | A1 | | 10/2003 | Robinson et al. | |
| 2004/0058781 | A1 | | 3/2004 | Plante | |
| 2004/0077464 | A1 | | 4/2004 | Feldman et al. | |
| 2004/0192522 | A1 | | 9/2004 | Hippensteel | |
| 2004/0209738 | A1 | | 10/2004 | Crawford et al. | |
| 2005/0202943 | A1 | | 9/2005 | Branch et al. | |
| 2005/0272566 | A1 | | 12/2005 | Otsuka | |
| 2006/0094573 | A1 | | 5/2006 | Weck | |
| 2007/0111866 | A1 | | 5/2007 | McVay | |
| 2008/0318738 | A1 | | 12/2008 | Chen | |
| 2009/0105046 | A1 | | 4/2009 | Rudich | |
| 2009/0181834 | A1 | | 7/2009 | Campanaro et al. | |

OTHER PUBLICATIONS

The Merriam Webster Dictionary, http://www.merriam-webster.com/dictionary/snap?show=1&t?1293826366, definition of "snap".

* cited by examiner

EXERCISE APPARATUS WITH RESILIENT FOOT SUPPORT

CROSS-REFERENCE TO RELATED APPLICATIONS

This application is a divisional of U.S. application Ser. No. 12/829,203, filed Jul. 1, 2010, which is a continuation of U.S. application Ser. No. 11/702,672, filed Feb. 6, 2007, now U.S. Pat. No. 7,806,805, and Ser. No. 11/592,139, filed Nov. 3, 2006, now U.S. Pat. No. 7,771,328. U.S. application Ser. No. 11/702,672 is a continuation-in-part of U.S. application Ser. No. 10/693,443, filed Oct. 27, 2003, now U.S. Pat. No. 7,179,207. U.S. application Ser. No. 11/592,139 is a continuation of U.S. application Ser. No. 10/693,443, filed Oct. 27, 2003, now U.S. Pat. No. 7,179,207, which in turn claims priority to U.S. Application No. 60/440,610, filed Jan. 17, 2003. The present application claims priority to all of the above applications. The entire content of each of the above applications is hereby incorporated by reference into the present specification.

BACKGROUND OF THE INVENTION

Field of the Invention

The present invention relates to methods of exercising and to exercise apparatuses with resilient foot supports for carrying out those methods.

Description of Related Art

One of the consistent challenges in the fitness industry is devising exercise methods and apparatuses that allow the user to achieve maximum, diverse fitness effects by performing exercises in comfortable positions. For example, a type or set of exercises may be particularly attractive and beneficial to the user if it provides strengthening, toning and cardiovascular benefits. Exercise equipment used to perform fitness exercises should ideally be relatively simple in construction, flexible in the types of exercises allowed, and adaptable to a wide range of resistances and levels of exertion.

A popular type of exercise equipment provides a pair of generally parallel tracks, on which a carriage is mounted for sliding or rolling movement along the tracks. Depending on the particular variation, the carriage may be connected to a resistance system including one or more resilient members, such as springs or bungee cords, which bias the carriage towards a particular position. The carriage may also be connected to pull lines that are trained over a pulley system, allowing the user to move the carriage by pulling the pull lines. The user exercises with such an apparatus by using the arms or legs to move the carriage along the tracks.

Sliding-carriage multi-function exercise equipment of this type also typically includes a foot rest or foot bar which extends in a direction generally perpendicular to the rails. The foot rest or foot bar is operationally fixed in position, and allows a user to control the movement of the carriage by exerting his or her leg muscles against it. A foot rest typically includes a set of frame members or frame portions that are adapted to connect to either the rails of the apparatus or other appropriate structures provided for that purpose. The frame members may also be attached to a rigid member, such as a board. The board is typically covered with a layer of foam or other cushioning material, which may be enclosed in a layer of outer material, such as vinyl. The foam and outer material cushion the user's feet to some degree and provide traction.

Rather than a board, the rigid member may comprise a generally U-shaped foot bar, which is typically a hollow bar that is adapted to be connected to the exercise apparatus at its ends. The top portion of the foot bar is covered with a traction/cushioning material. The user typically places his or her hands or feet on the cushioned portion of the foot bar to control the movement of the carriage.

One variation of the above-described type of exercise apparatus is disclosed in U.S. Pat. No. 5,967,955, which is incorporated herein by reference in its entirety. The disclosed apparatus includes a movable carriage mounted on generally parallel tracks and a foot rest of the type described above. The apparatus does not use resilient members to provide resistance; instead, resistive bias is provided by inclining the tracks at one of a number of angular orientations, thereby allowing the user to move the carriage by working against a corresponding fraction of his or her own weight bias under the influence of gravity using a pulley system that is coupled to the carriage. As the angular orientation of the carriage changes, the fraction of the user's weight bias changes correspondingly, such that at greater inclinations, the weight bias that the user works against is greater.

Another variation of the above-described type of exercise apparatus is that sold under the general name Pilates Performer™ (Stamina Products, Inc., Springfield, Mo., United States) for use with the Pilates exercise system. An apparatus of this type is shown in U.S. Pat. No. D382,319 to Gerschefske et al., the contents of which are incorporated by reference in their entirety. The apparatus includes a frame having a pair of generally parallel tracks that support a movable carriage which is mounted on the tracks with rollers for rolling horizontal movement along the tracks. A set of tensile resilient resistance elements is connected to the frame at one end and to the carriage at the other, thereby biasing the carriage towards a particular position. A pulley system and associated pull lines are coupled to the carriage, such that the carriage may be moved by application of force to the pull lines. A foot bar is provided at one end of the frame, and shoulder blocks are provided at one end of the carriage, allowing the user to position him or herself in a supine position to move the carriage against the resilient bias provided by the tensile resilient resistance elements using the muscles of either the legs or the arms.

SUMMARY OF THE INVENTION

One aspect of the invention relates to a method of enabling a person to exercise. The method comprises providing a movable body support for the exercising person which supports the exercising person in a position which allows the body of the exercising person to move with the movable body support while the feet of the exercising person are free to be moved with respect to the movable body support and providing a movable foot support separate from the body support in a position to be engaged by the feet of the exercising person supported on the movable body support. The method also comprises providing for the absorption of the energy of the movement of the movable body support in a first direction away from the movable foot support by the exercising person supported thereon and the conversion of the absorbed energy to a movement of the movable body support with the exercising person supported thereon in a second direction toward the movable foot support. Additionally, the method comprises providing for the controlled yielding of the movable foot support caused by the engagement thereof by the feet of the exercising person moving with the movable body support in the second direction and establishing as a result of the controlled yielding a bouncing movement by the movable foot support in the first direction, which the exercising person can translate into a movement of the movable body support in the first direction. The arrangement is such that the exercising person can control the repetition and magnitude of the movements of the movable body support by flexure of the legs at the knees.

Another aspect of the invention relates to an exerciser. The exerciser comprises a frame assembly, a movable body carriage supported by the frame assembly and constructed and arranged to support the body of an exercising person in a position which allows the body of the exercising person to move with the movable body carriage while enabling the feet of the exercising person to be moved with respect to the movable body carriage, and a resilient foot engaging assembly coupled with the frame assembly and constructed and arranged to be engaged by the feet of the exercising person supported on the movable body carriage, the movable body carriage being supported for movement in a first direction away from the resilient foot engaging assembly and a second direction toward the resilient foot engaging assembly, and the resilient foot engaging assembly being releasably fixed relative to the frame assembly and constructed and arranged to yield resiliently in response to the engagement of the feet of the exercising person moving with the movable body carriage in the second direction and to establish, as a result of the resilient yielding, a bouncing movement by the resilient foot engaging assembly in the first direction which can be translated by the exercising person into a movement of the movable body carriage in the first direction, the resilient foot engaging assembly being releasable from the fixed relation relative to said frame assembly and being constructed and arranged to independently function as a floor engaging exercising unit by itself.

A further aspect of the invention relates to an attachment for an exerciser of the type including a movable body support disposed on a frame assembly in a position to support the body of an exercising person in a position which allows the body of the exercising person to move with the movable body support while enabling the feet of the user to be free from the movable body support, a foot assembly adapted to be mounted on the frame assembly in a position to be engaged by the feet of the exercising person supported on said movable body support, and mounting structure disposed on the frame assembly, the mounting structure being constructed and arranged to detachably mount the foot assembly to the frame structure. The attachment comprises a movable foot support constructed and arranged to cooperate with the mounting structure to be mounted on the frame assembly in lieu of the foot assembly in a position to be engaged by the feet of a user supported on the movable body support. The movable foot support is constructed and arranged to yield resiliently in response to the engagement of the feet of the user supported on the movable body support therewith in a second direction toward the movable foot support and to establish, as a result of the resilient yielding, a bouncing movement by the movable foot support in a first direction which can be translated by the user into a movement in said first direction of said movable body support.

Another aspect of the invention relates to a dual mode exercising apparatus comprised of a resilient foot engaging unit including a unit frame having resilient foot engaging structure thereon, the unit frame being constructed and arranged to be supported on a horizontal floor surface in a first angled position so as to enable a user to perform exercise movements in which the user moves downwardly on the resilient foot engaging structure which bouncingly returns an upward movement to the user, and an exerciser constructed and arranged to have the resilient foot engaging unit removably attached thereto in an operative position wherein the unit frame is supported in a second angled position disposed at an angle to the horizontal, the exerciser including a body carriage movable in opposite directions under a resistance system for supporting a user thereon in such a way that the user can, during a movement of the body carriage in one direction, engage the resilient foot engaging structure with the user's feet and use the bouncingly return movement thereof to effect a movement of the body carriage in a direction opposite the first direction.

Another aspect of the invention relates to an exerciser comprised of a track, a movable body carriage mounted on the track to enable movement of the movable body support along the track in opposite directions, an elastically deformable foot engaging assembly arranged to be engaged by feet of an exercising person supported by the movable body carriage, the movable body carriage being movable in a first direction away from the elastically deformable foot engaging assembly and a second direction toward the elastically deformable foot engaging assembly, the elastically deformable foot engaging assembly being elastically deformable upon receipt of force applied by engagement of the feet of the exercising person, wherein the elastic deformation of the elastically deformable foot engagable applies a force against the feet of the exercising person to facilitate a movement of the movable body carriage in the first direction away from the elastically deformable foot engaging assembly, the elastically deformable foot engaging assembly including an inflated bladder.

Another aspect of the invention relates to an exercising apparatus comprised of a frame structure constructed and arranged to be supported on a horizontal surface, a foot engaging unit disposed on the frame structure, a movable body carriage mounted on the frame structure for movement toward and away from the foot engaging unit, and an electromechanical system between the frame structure and the movable body carriage for biasing the movable body carriage toward the foot engaging unit and for resisting movement of the movable body carriage away from the foot engaging unit, the electromechanical system including an electrical control circuit for electrically controlling the amount of bias and resistance provided by the electromechanical system.

Some improvements of the present invention are also based upon a dual concept. The first concept is that it can be beneficial to provide an attachment, which can be used both as the spring-biased attachment for the pilates-type exerciser and as an independently operable exerciser by itself. The second concept is that an inflatable dome-type exerciser can be used in practicing the first concept although the unit could be a small floor mounted trampoline or an inflatable exerciser ball as well. Examples of dome-type exercisers are disclosed in U.S. Pat. Nos. 6,702,726 and 6,422,983, the disclosures of which are hereby incorporated by reference into the present specification.

Accordingly, another aspect of the present invention is to provide a method of enabling a person to exercise in either one of two different modes comprising providing a resilient foot engaging unit and an exercising apparatus capable of selectively (1) coupling the resilient foot engaging unit with the exercising apparatus to provide the user with one mode of exercise and (2) releasing the resilient foot engaging unit from the exercising apparatus for use by itself to provide the exercising person with a different mode of exercise.

In one embodiment, the resilient foot engaging structure comprises an inflated dome-shaped bladder.

Still another aspect of the present invention is to provide an improvement wherein the pilates-type of exerciser has a resilient foot engaging assembly of an independent floor supported exercising function releasably secured thereto in place of the usual inverted U-shaped foot bar.

Another aspect of the present invention is the provision of an electromechanical, and, in one embodiment, an electromagnetic system for providing biased movement and resistance to movement for the movable body carriage of the exerciser.

Other aspects of the invention will become apparent from the following description.

DESCRIPTION OF THE DRAWINGS

The invention will be described with reference to the following drawings, in which like numerals represent like features throughout the figures, and in which.

DETAILED DESCRIPTION

Figure 1:
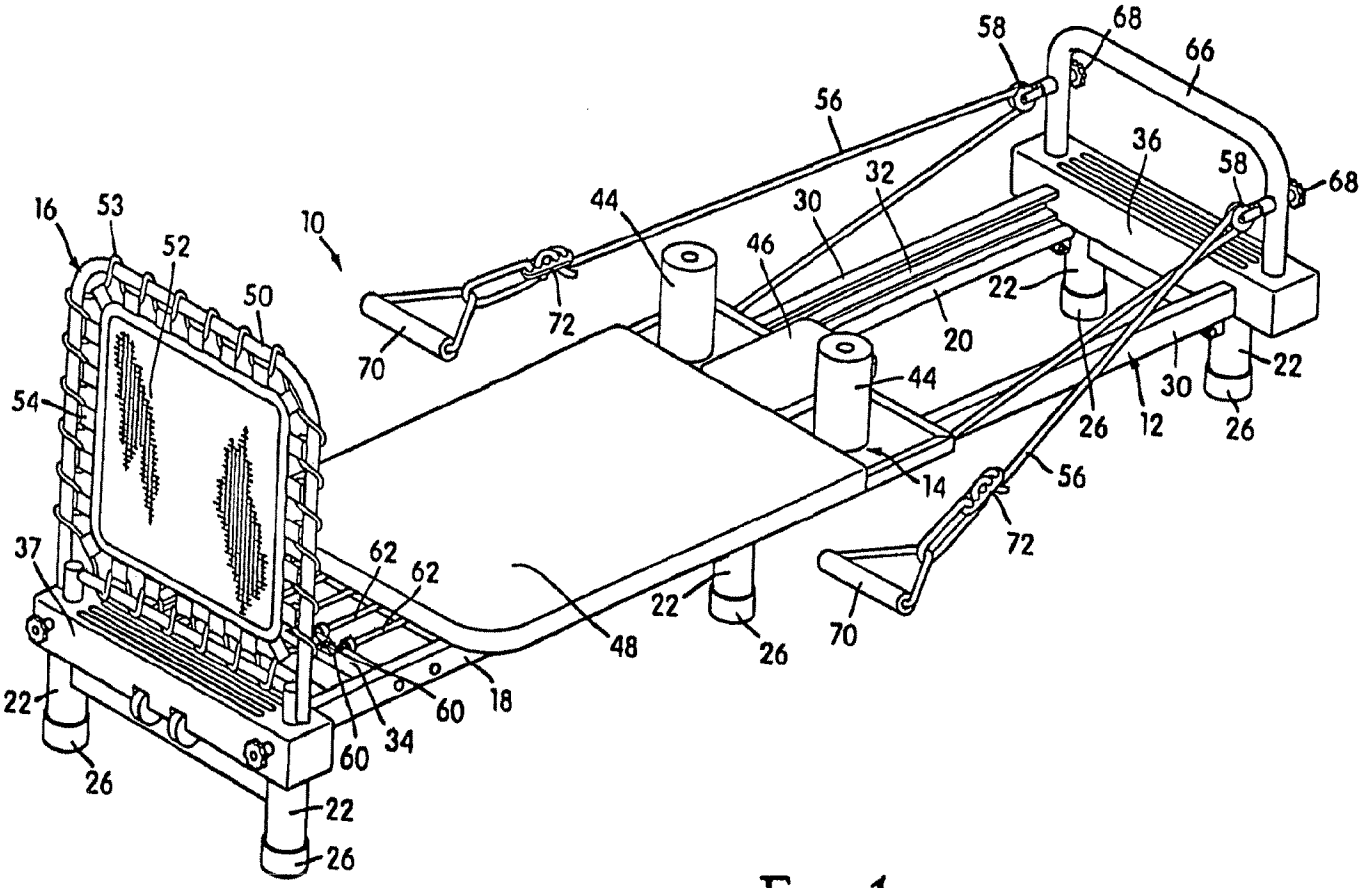
FIG. 1 is a perspective view of an exerciser according to an embodiment of the present invention.

FIG. 1 is a perspective view of an exerciser, generally indicated at 10, according to one embodiment of the invention. The exerciser 10 is generally of the type shown in U.S. Pat. No. Des. 382,319, which was incorporated by reference above. The exerciser 10 includes a frame assembly, generally indicated at 12, a movable body carriage or support, generally indicated at 14, disposed on the frame structure 12 in a position to support the body of the user in a position enabling the feet of the user to be free from the movable body support 14, and a resiliently movable foot support, generally indicated at 16, constructed and arranged to be mounted on the frame structure 12 in a position to be engaged by the feet of the user supported on the movable body support 14.

Figure 2:
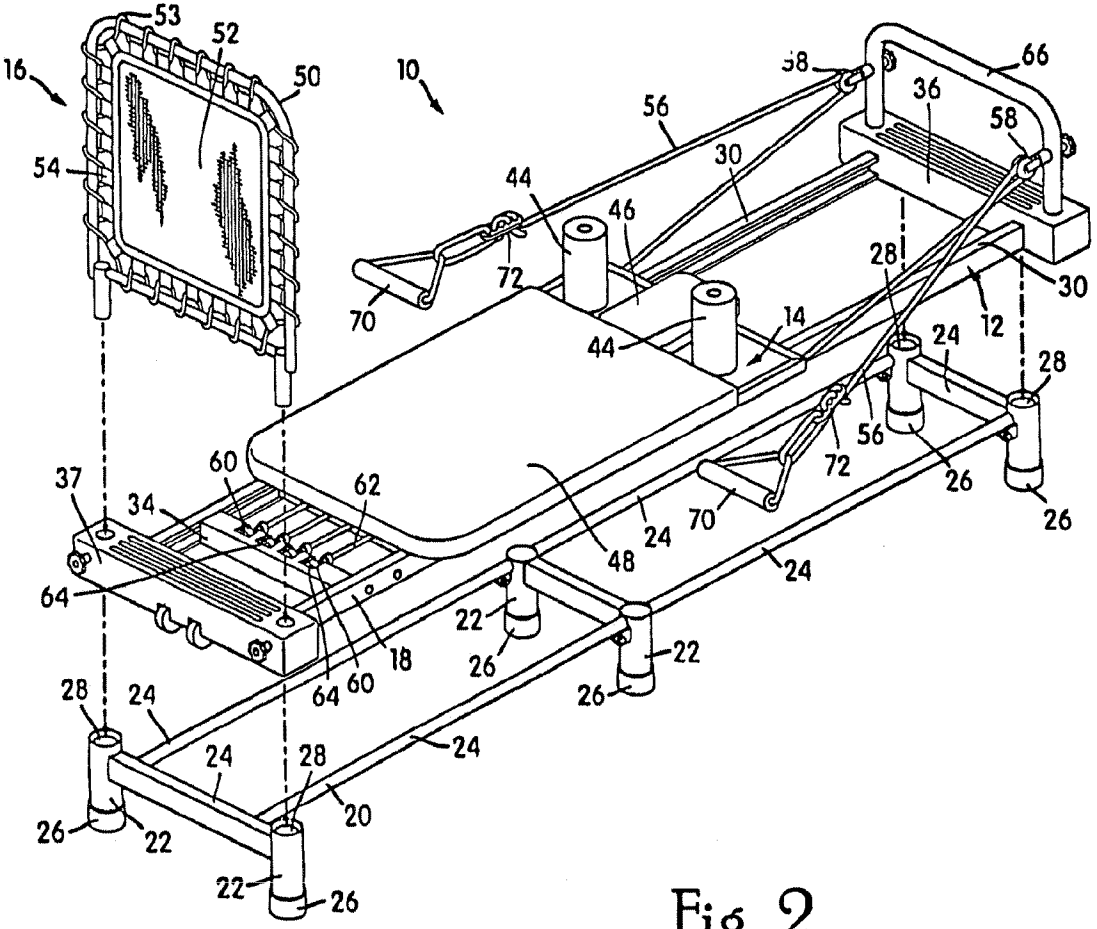
FIG. 2 is an exploded perspective view of the exerciser of FIG. 1.

The frame assembly 12 includes a frame 18, which is adapted to support the movable body support 14, the foot support 16, and the user, as well as a stand 20, which is adapted to connect to the frame 18 to hold the frame 18 in a generally horizontal plane above floor level. As is shown in FIG. 2, an exploded perspective view of the exerciser 10, the stand 20 comprises a plurality of legs 22 connected at respective upper ends thereof by cross bars 24, such that the stand portion 20 is comprised of generally rectangular or trapezoidal segments having legs 22 disposed at the corners of the segments. End caps 26 of a rubber or other non-skid material may be provided at floor-contacting ends of the legs 22. Upper receptacle sections 28 of the stand 20 are adapted to receive corresponding mating structures provided on the underside of the frame 18 (not shown in the Figures), so as to operatively secure the frame 18 to the stand 20. The legs 22 of the stand 20 may be of any length that provides a convenient user height for the frame portion 18.

Depending on the embodiment, the frame 18 and stand 20 may be separable, so that the exerciser 10 can be stored easily. Additionally, the stand 20 may be omitted or sold separately, particularly if the height provided by the stand 20 is not required for the exercises that are to be performed. Moreover, it may be desirable to construct the stand 20 such that one end is wider than the other. A stand 20 with one wider end and one narrower end may be desirable if one end of the exerciser 10 requires a broader base of support to prevent lateral tipping, or if the exerciser 10 is constructed such that the stand 20 will only mate with the frame 18 if the frame 18 is in a particular orientation.

In one embodiment, the frame 18 may be comprised of two generally parallel support tracks 30, connected and braced by a number of cross members. Each of the support tracks 30 has a generally C-shaped cross-section, such that each support track 30 defines an interior track 32, in the shape of a channel, which is adapted to receive engaging portions of the movable body support 14. The engaging portions of the movable body support 14 in this embodiment are rollers 33 (shown in phantom in FIG. 3) that rollingly engage interior tracks 32. The rollers 33 are mounted to the underside of the movable body support 14 on appropriately-sized bearings or projections, and allow the movable body support 14 to roll along the support tracks 30 between limiting portions of the support tracks 30. The limiting portions of the support tracks 30 define the extent of travel for the movable body support 14. In the exerciser 10, one of the limiting portions is a crossbar 34 that extends between the two support tracks 30; the other limiting portion is defined by an endpiece 36 of the frame portion 18. Alternatively, the limiting portions may simply be the ends of the grooves 32 in the support tracks 30.

Although rollers 33 are used in the illustrated embodiment, a number of other types of bearings and other movement support structures are known in the art, and any one of these known types of bearings may be used in place of the rollers. For example, instead of rollers, blocks of low-friction material may be used, and the inside tracks 32 in the support tracks 30 may be lubricated in order to facilitate sliding movement with reduced friction.

Figure 3:
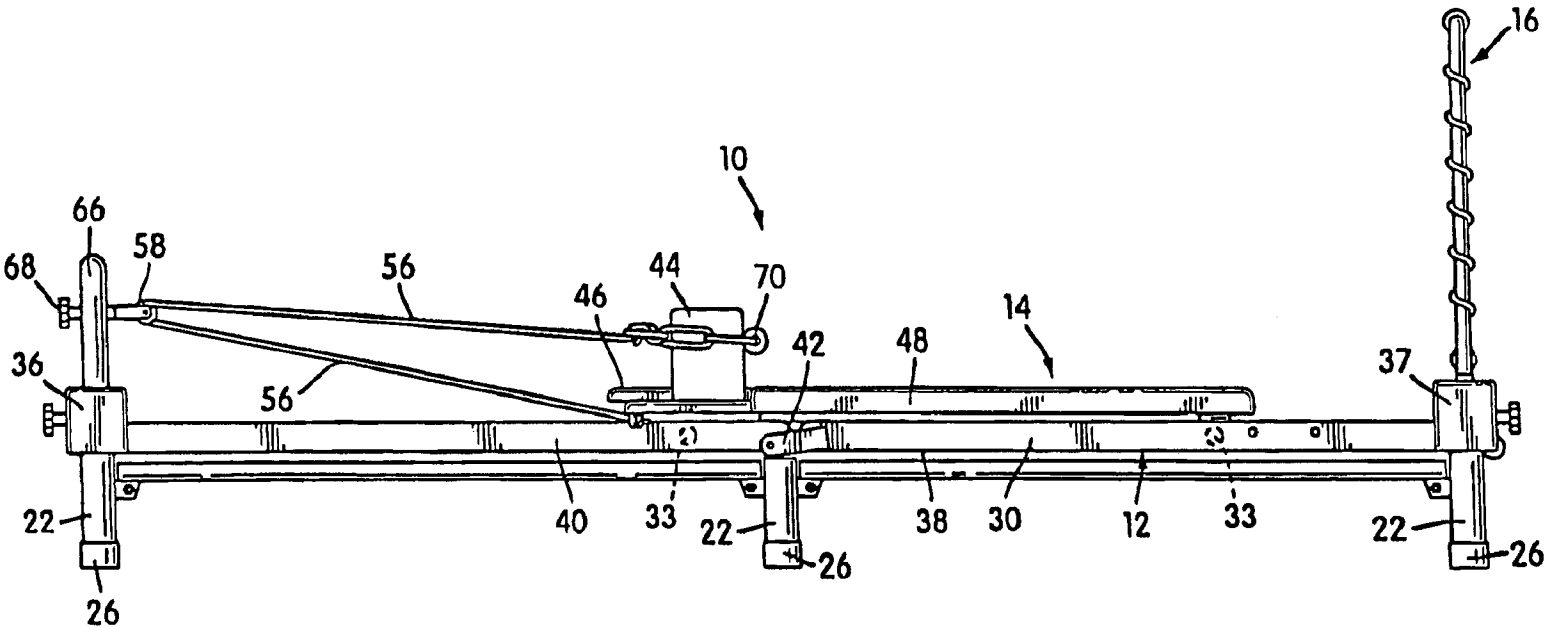
FIG. 3 is a side elevational view of the exerciser of FIG. 1.

The support tracks 30, in one embodiment, may be continuous bars that run the length of the exerciser, or they may be comprised of sets of shorter bars which are secured together by welds or fasteners. As shown in FIG. 3, each support track is comprised of two shorter support bars 38, 40. At one end, each shorter support bar 38, 40 connects to an endpiece 36, 37 to form an end of the frame 18 of the exerciser 10. (The endpieces 36, 37 of the illustrated embodiments are bars covered with decorative plastic moldings, but they may be made in other configurations.) At the other ends of the shorter support bars 38, 40, cooperating hinge structure 42 is provided, such that the shorter support bars 38, 40 may be hingedly connected together in a manner which allows the exerciser 10 to be folded when not in use.

In alternative embodiments of the invention, the support tracks may have a substantially rectangular cross section, and a movable body support with rollers or other movement support structures may be configured so as to rest on top of the support tracks, rather than engaging inside tracks defined within them. The precise manner of engagement of the movable body support and the support tracks is not critical.

Several body-engaging components can be mounted on the movable body support 14 so as to facilitate the body positioning of the user. Two padded shoulder blocks 44, one on each side of the body support 14, extend vertically, and are positioned so as to engage the upper portion of the user's torso (i.e., at the collarbone or shoulder region) when the user is lying prone or supine on the movable body support 14, so as to prevent the user from sliding relative to the movable body support 14 in a direction away from the foot support 16. The shoulder blocks 44 may be removably attached to the movable body support 14, for example, by a threaded connection.

A padded head rest 46 can also be mounted on the movable body support 14. In the position illustrated in FIGS. 1 and 2, the head rest 46 is positioned such that its user-contacting surface is generally horizontal and co-planar with those of the movable body support 14. However, the head rest may be mounted on a multi-position bracket, such that its angular position may be adjusted relative to that of the movable body support so as to support the user's head in an inclined position. In addition to the head rest 46, torso pad 48 is mounted on the movable body support 14 so as to cover a substantial portion of the movable body support 14 to provide traction and comfort.

Figure 4:
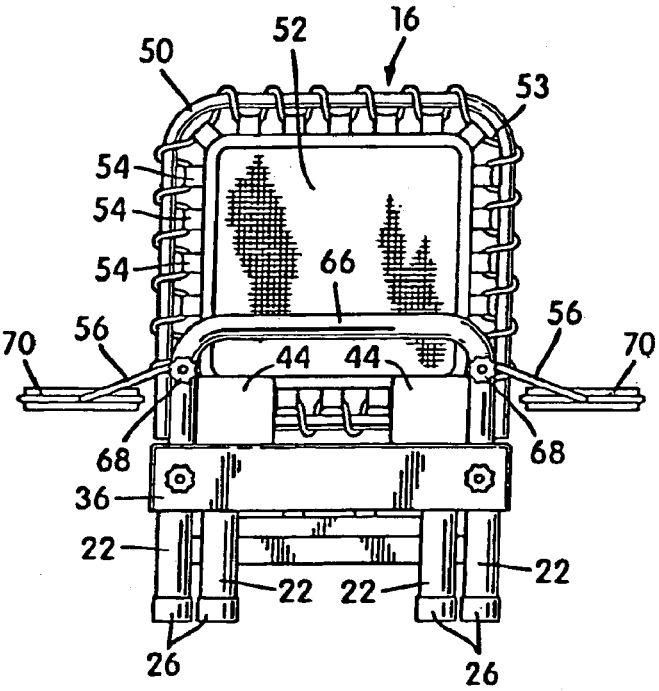
FIG. 4 is an elevational view of one end of the exerciser of FIG. 1.
Figure 5:
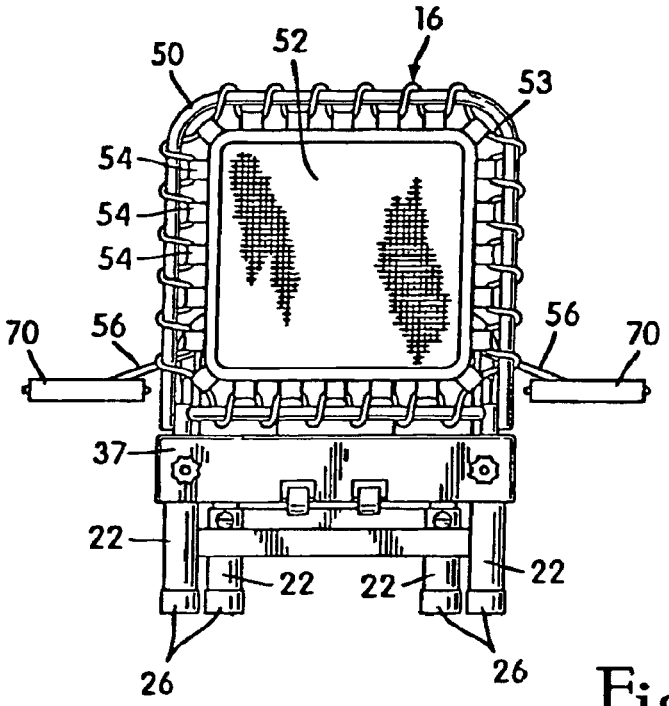
FIG. 5 is an elevational view of the other end of the exerciser of FIG. 1.

When the user is lying on the movable body support 14 in either prone or supine position with his or her head on the head rest, the user's feet are free to move with respect to the movable body support 14, and extend in a direction toward the resiliently movable foot support 16. As can be seen in FIG. 1 and in the end elevational views of FIGS. 4-5, in one embodiment, the foot support 16 comprises a generally rectangular peripheral frame member 50 that extends vertically, perpendicular to the orientation of the movable body support 14. Resiliently attached to the peripheral frame member 50 is a flexible sheet member 52. In the illustrated embodiment, the peripheral frame member 50 has a generally circular cross section, and a fabric flexible sheet member 52 is attached to the peripheral frame member 50 by a series of elastomeric, resilient, extensible cords 53 that are wrapped around the peripheral frame member 50 and pass through eyelets 54 provided along the edges of the fabric flexible sheet member 52. The fabric flexible sheet member 52 may be nylon, canvas, or another suitable fabric capable of withstanding exercising use. The elastomeric, resilient, extensible cords 53 may comprise, for example, several strands of an elastomeric rubber encased in a fabric outer casing.

In addition to the arrangement shown in the figures and described above, the foot support 16 may be made in a variety of configurations and of a number of materials. For example, instead of being wrapped around the frame member, elastomeric cords or tension coil springs could be secured at first ends within the interior of a hollow peripheral frame member and could extend from it, being secured to the flexible sheet member at respective second ends. Alternatively, the flexible sheet member itself may be made of a resilient, elastomeric material, such as rubber, and may be secured to the frame member with adhesives or fasteners, without elastomeric cords. Moreover, the foot support could comprise an inflated resilient bladder supported by a peripheral frame or a rigid backing member, or it could comprise a board or other rigid member resiliently mounted on springs. In general, other embodiments of the invention would be designed to simulate the type of motion produced using the foot support 16. Other embodiments of the foot support will be described in more detail below.

In one embodiment, the exerciser 10 may also carry a resilient resistance system coupled to the movable body support 14. The crossbar 34 proximate to the footrest has several slots 60 formed in it. Each slot 60 in the crossbar is sized and adapted to accept one end of a tensile resilient resistance element 62. A bracket on the underside of the movable body support 14 (not shown in the figures) includes a corresponding set of slots 60, each slot 60 adapted to accept the other end of a tensile resilient resistance element 62. In this embodiment, the crossbar 34 and bracket of the movable body support 14 each include four slots 60; however, the number of slots 60 may be selected arbitrarily, depending on the total desired resistance, the width of the crossbar 34 and bracket, and the total amount of space required for each resilient resistance element 62. The exerciser 10 may be operated with any number of resilient resistance elements 62 installed in the slots.

The tensile resilient resistance elements 62 illustrated in FIGS. 1 and 2 are elastomeric cords with knobs 64 installed at the ends, so that the ends may be seated in the slots provided for them. The tensile resilient resistance elements 62 may also comprise tension coil springs, rubber bands, or similar structures. Depending on the type of resilient resistance elements 62, hooks or other receiving structures may be used instead of slots. As those of skill in the art will appreciate, one of the functions of the tensile resilient resistance elements 62 is to bias the movable body support 14 to return to a position proximate to the movable foot support 16 when moved by the user away from the movable foot support 16. However, particularly if the movable body support 14 is inclined and able to move under the influence of gravity, or if some other return mechanism is used, the resilient resistance system may be omitted.

The exerciser 10 of FIG. 1 also carries an arm exercise system. Two pull lines 56 are connected to the underside of the movable body support 14. From the underside of the movable body support 14, the pull lines 56 are trained over pulleys 58 that are carried by an upright bar 66 provided on the end of the exerciser opposite the foot support. The pulleys 58 are adapted to swivel, so as to allow the user to pull the pull lines 56 toward the foot support 16 in a variety of planes of motion. They pulleys 58 are also releasably mounted on the upright bar 66 by mounting structure 68 so that their angle and orientation can be changed by the user.

From the pulleys 58, the pull lines 56 extend towards the foot support 16, and are coupled to user grips 70 at their ends. Between the ends of the pull lines 56 and the user grips 70, take-up fittings 72 are provided. Each take-up fitting has a number of holes 74 formed in it, such that if the pull lines are too long, they may be wrapped around and through the take-up fittings 72 to reduce their effective lengths. When the user grips the user grips 70 and causes the pull lines 58 to extend, he or she is working against the force bias provided by the tensile resilient resistance elements 62. The arm exercise system, including the pull lines 56, pulleys 58 and associated structures is an optional feature, and may not be included in some embodiments of the invention.

The foot support 16 is constructed and adapted to yield in a controlled manner in response to the engagement of the user's feet therewith in a direction toward the foot support 16 and to establish, as a result of the controlled yielding, a bouncing movement by the foot support 16 in the opposite direction, which can be translated by the user into a movement of the movable body support 14 in that opposite direction. In this context, the term "bouncing movement" may refer to movements during which the feet of the user lose contact with the foot support 16, as well as resilient movements during which the feet of the user remain in contact with the foot support 16. The term "feet" may refer to both of the user's feet together or to one individual foot; the exercises shown described here may be performed with one foot, each foot alternately, or both feet simultaneously. The terms "controlled yielding" and "resilient yielding" imply that the foot support 16 or individual foot portions thereof yield in such a manner that they are biased to return to their original position.

By the operation of the resilient resistance system, the movable body support 14 is constructed and arranged to absorb the energy of movement of the user on the movable body support in a direction away from the foot support 16 and to convert that absorbed energy into a movement toward the foot support 16.

In one embodiment, the user may control the degree of resistive bias by changing the number of tensile resistive elements 62 that are connected between the crossbar 34 and the movable body support 14. The pull lines 56 are constructed and arranged such that forces applied in a direction toward the foot support 16 by the user's arms are converted into movements of the movable body support 14 away from the foot support 16. Alternatively, the user may control the position of the movable body support 14 solely by flexure of the legs against the foot support 16.

Figure 6A:
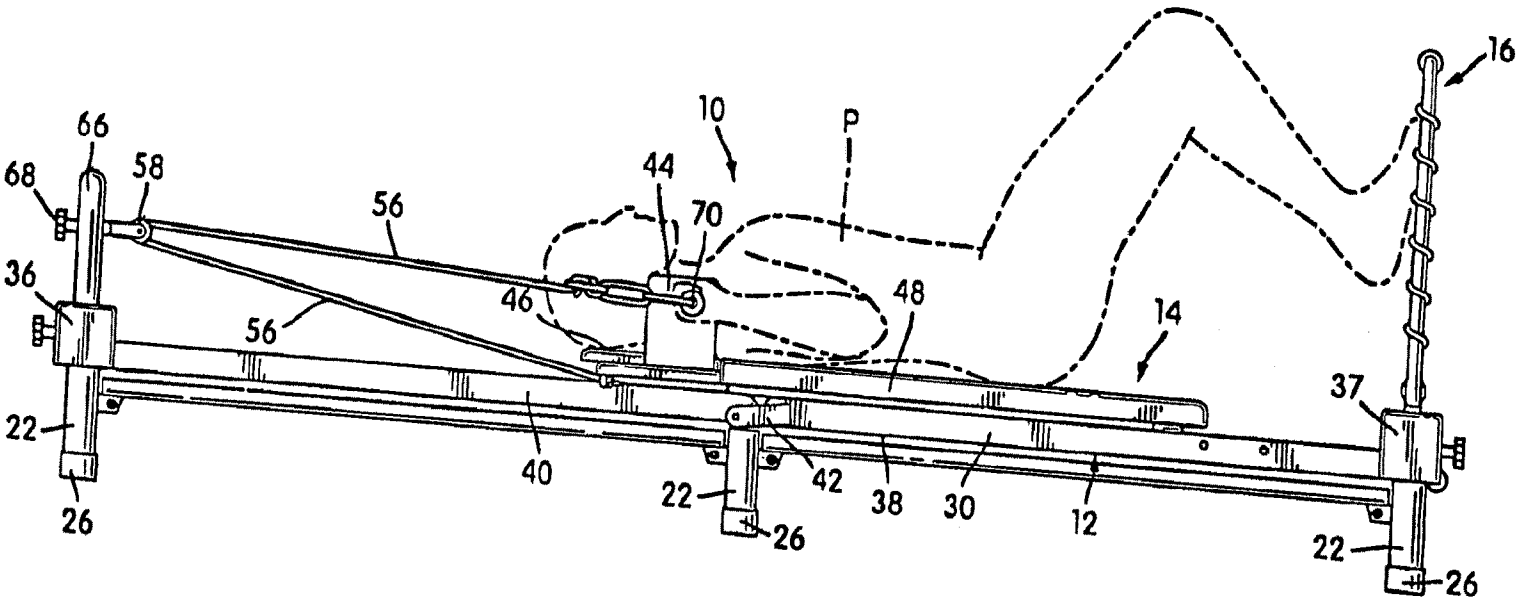
FIGS. 6A-6C are side elevational views of the exerciser of FIG. 1 in various operative positions.
Figure 6B:
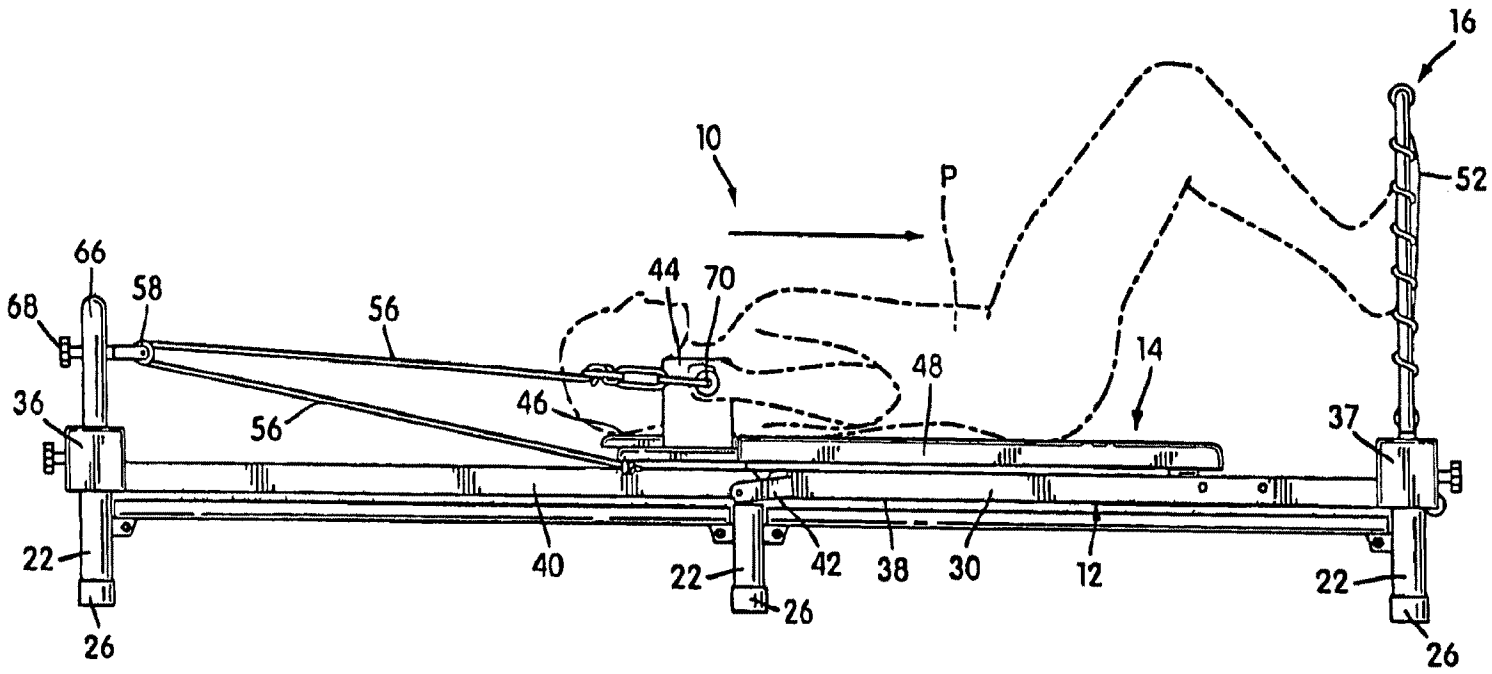
Figure 6C:
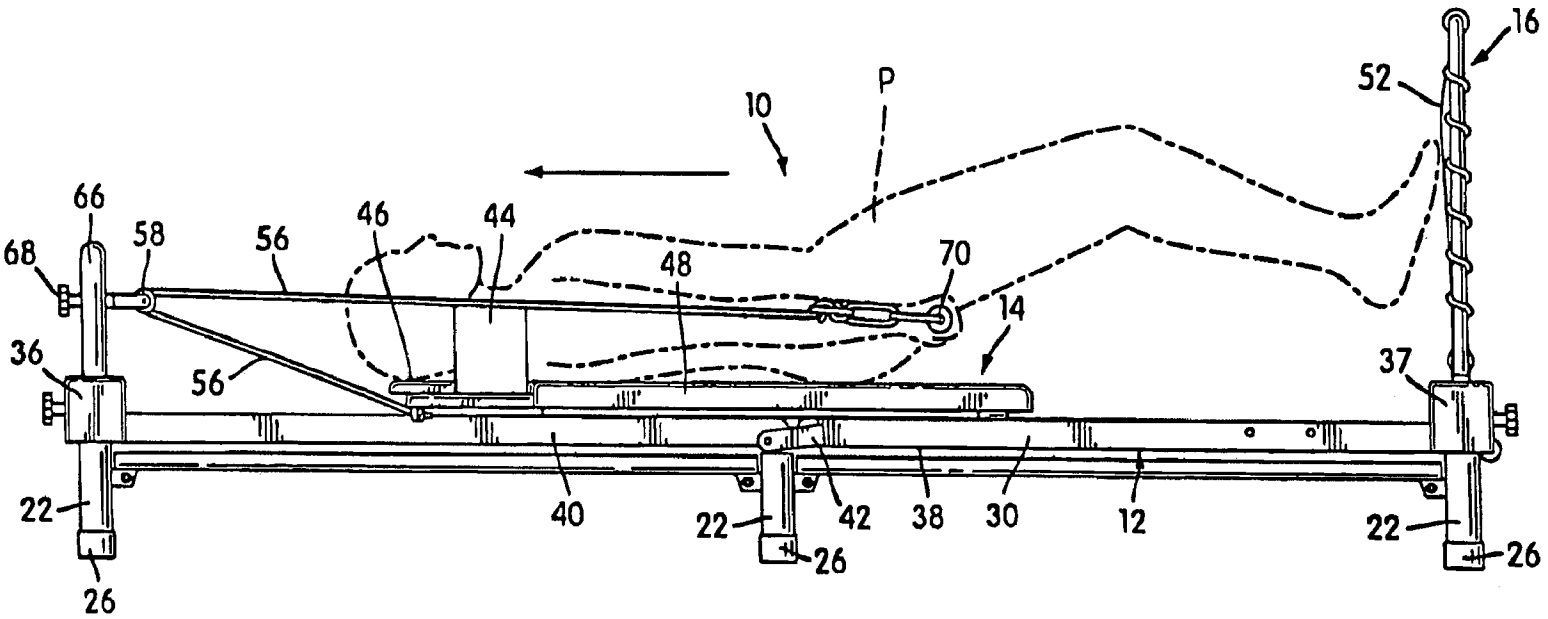

One exemplary type of exercise that may be performed with the exerciser 10 is shown in FIGS. 6A-6C, although many types of exercises may be performed. As shown in FIG. 6A, the user P lies on the movable body support 14 in an essentially supine position, flexed at the knees, with the bottoms of his or her feet in contact with the flexible sheet member 52 of the foot support 16. In FIG. 6A, the user P is also gripping the user grips 70, and the pull lines 56 are extended forwardly. In the view of FIG. 6B, the user P has moved the movable body support 14 towards the foot support 16, causing the flexible sheet member 52 to deflect. In the view of FIG. 6C, the resiliency of the elastomeric cords 62 attached to the flexible sheet member 52 has caused the flexible sheet member 52 to rebound, creating a bouncing movement by the foot support 16 that the user P can translate into a movement of the movable body support 14. As shown in the FIG. 6C, the movable body support 14 has moved in a direction away from the foot support 16. The degree of bouncing shown in FIG. 6C is for illustrative purposes. The actual amount of bouncing or resiliency will vary with the type of flexible sheet member 52 and elastomeric cords 62 that are used, as well as the way in which the user P controls the movement. The movements illustrated in FIGS. 6A-6C may be repeated any desired number of times at any desired frequency.

During the movements illustrated in FIGS. 6A-6C, the feet of the user P may or may not lose contact with the foot support 16, depending on how the user P controls the movement. If the feet of the user P do lose contact with the foot support 16 during the bouncing movement, the separation distance may be at least partially controlled by the user P by exerting the muscles of the legs and/or abdomen appropriately when initially contacting the foot support 16 or thereafter.

The exerciser 10 may be used for a number of different types of exercise; the positions shown in FIGS. 6A-6C are merely exemplary. In particular, the user P may exercise using any combination of arm, leg, or arm and leg movements. If the user P uses both arm and leg movements during the exercise motions, as is shown in FIGS. 6A-6C, the effects of the arms and legs on the movement of the movable body support 14 are additive. The use of the foot support 16 may be particularly helpful in exercising the abdominal muscles, because the flexed-knee position of the user P will cause some of the exercising forces to be absorbed by and/or exerted by the abdominal muscles.

Figure 7:
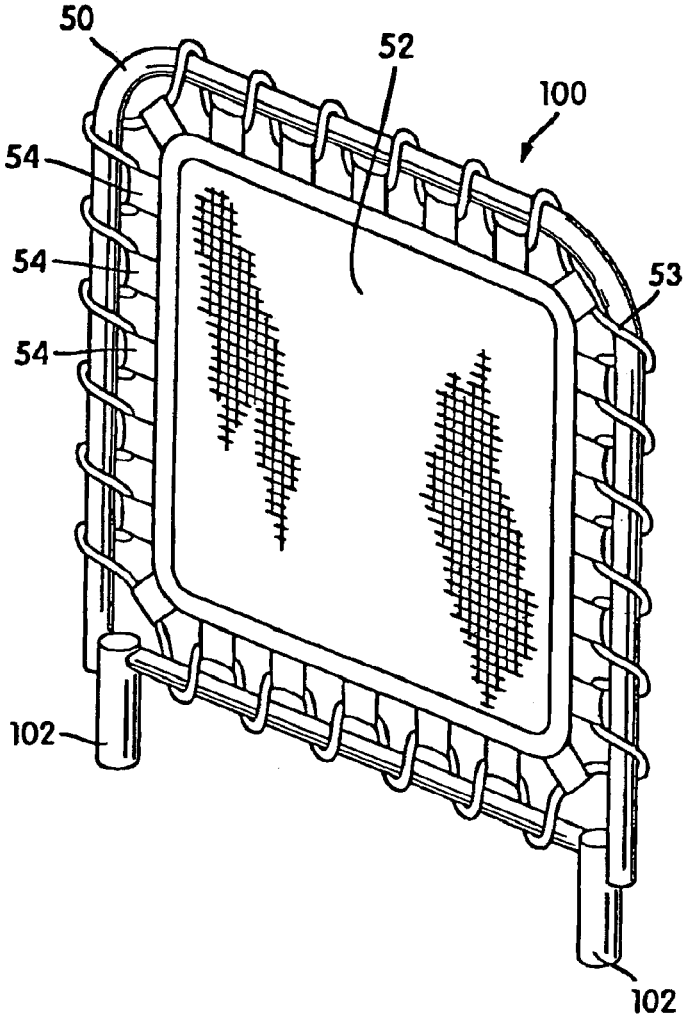
FIG. 7 is a perspective view illustrating an exerciser foot rest attachment according to the invention.

In addition to being installed on and included with an exercise machine like that shown in FIGS. 1-6, in one embodiment, a foot support may also be sold and used as a separate attachment constructed and arranged to be installed or retrofitted on an exercise apparatus in lieu of a conventional foot bar or foot support. FIG. 7 illustrates a foot support 100 as it might be sold or used as an attachment. The foot support 100 includes connecting structures or portions 102 for connecting the foot support 100 with appropriate receptacles provided in the exercise apparatus. Depending on the configuration of the exerciser, the connecting structures 102 may simply be the terminal portions of the frame member 50 of the foot support. Alternatively, they could be keyed or shaped shafts, or could include some other structure adapted to cooperate with the receptacles of the exerciser to lock the foot support 100 into position within the exerciser. Additionally, a foot support attachment 100 may have any of the features described above with respect to the foot support 16.

Figure 8:
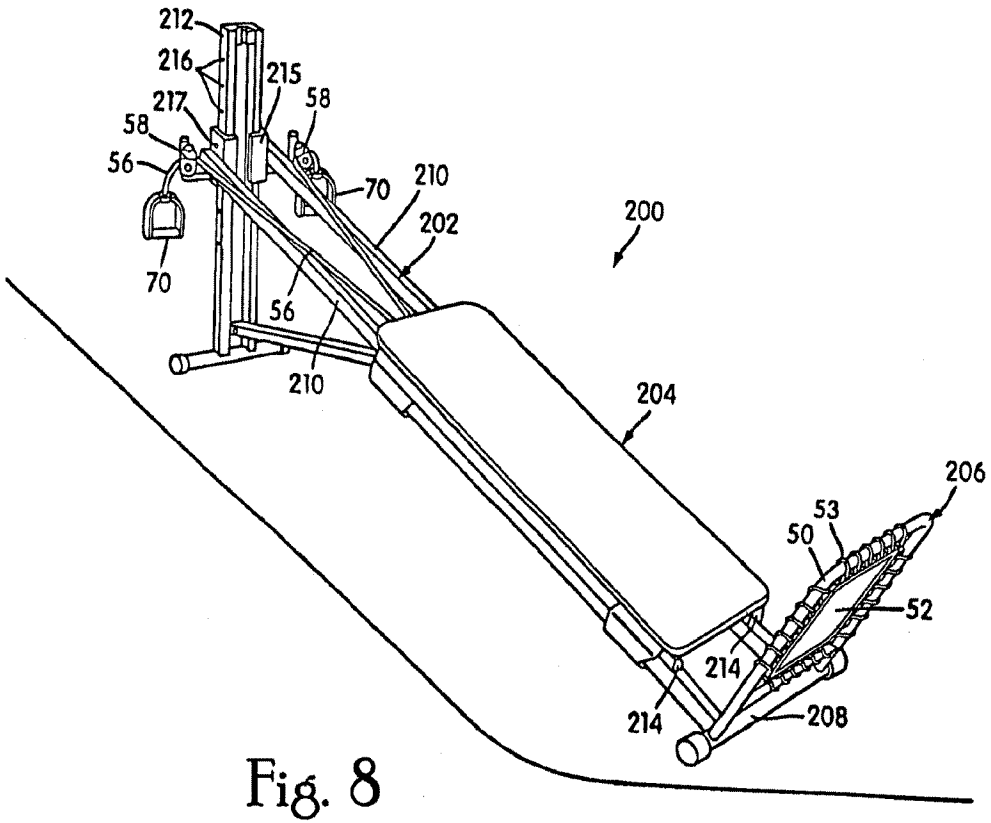
FIG. 8 is a perspective view of an exerciser according to another embodiment of the invention.

An exerciser 200 according to another embodiment is shown in the perspective view of FIG. 8. The exerciser 200 may incorporate some or all of the structure and features described in U.S. Pat. No. 5,967,955, which was incorporated by reference above.

In general, the exerciser 200 includes a frame assembly, generally indicated at 202, a movable body support, generally indicated at 204, mounted on the frame assembly 202 for movement between limiting positions on the frame assembly 202, and a resiliently movable foot support, generally indicated at 206. The resiliently movable foot support 206 is essentially identical to the foot supports 16, 100 described above, with the exception that it is particularly adapted to be inserted into an end crossmember 208 provided at the foot end of the frame structure 202. Because the foot support 206 is essentially identical to the foot supports 16, 100 described above, the description above will suffice to describe it.

Figure 9:
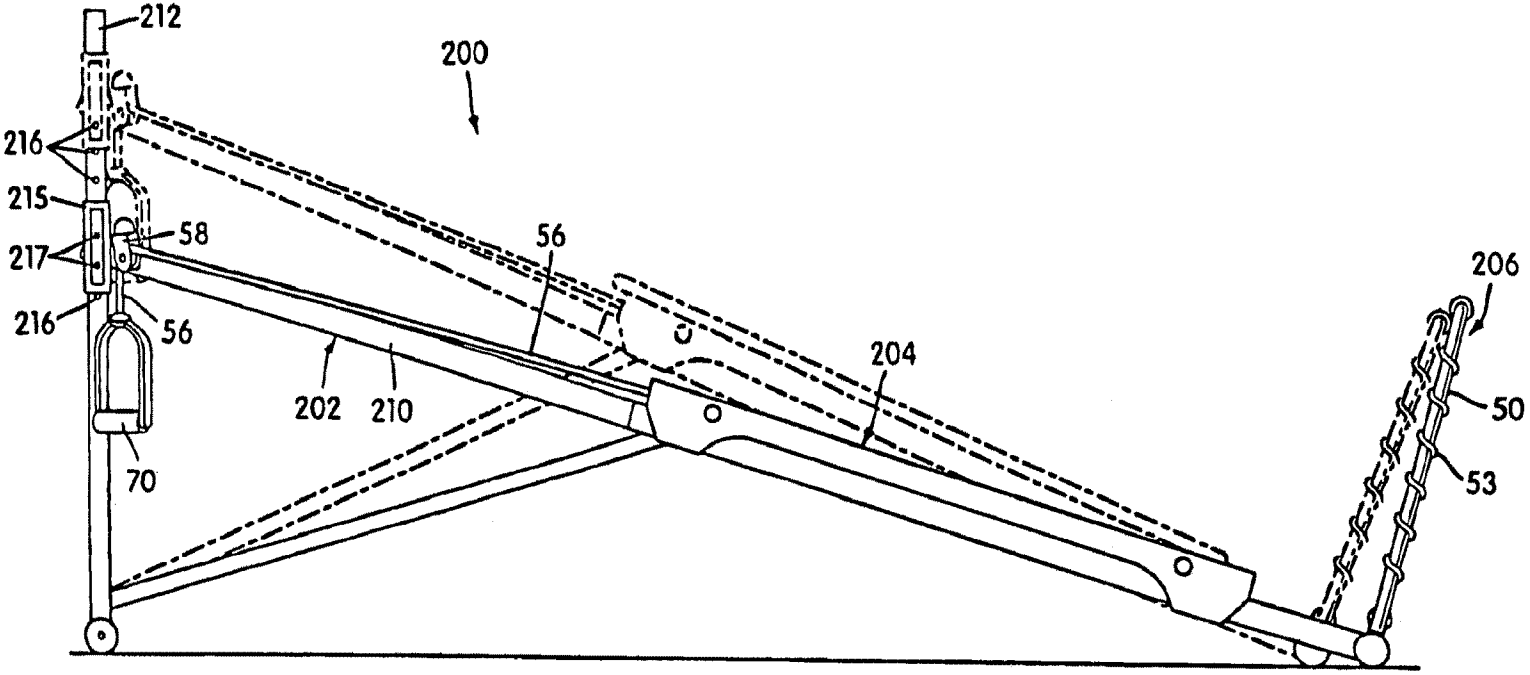
FIG. 9 is a side elevational view of the exerciser of FIG. 8.

In one embodiment, the exerciser 200 does not include a resilient resistance system; instead, as shown in the side elevational view of FIG. 9, the frame assembly 202 includes two generally parallel support tracks 210, which are supported on an inclined plane by a stand 212. With this arrangement, the movable body support 204 is mounted for movement along the inclined plane defined by the tracks 210. The tracks 210 of the exerciser 200 of this embodiment do not include interior tracks; instead, the movable body support 204 rests on top of the tracks 210, and is supported by rollers 214.

As supported by the stand 212 on the inclined plane, the movable body support 204 absorbs the energy of movement of a user supported thereon moving along the tracks 210 up the inclined plane because the user is working against the influence of gravity, and is thus storing potential energy. The movable body support 204 converts the absorbed energy into a movement along the tracks 210 down the inclined plane because the absorbed/stored potential energy is converted to kinetic energy.

In other words, the user is working against a portion of his or her own body weight, which provides the user with exercising resistance. The amount of exercising resistance may be varied by varying the incline of the tracks 210. As shown, the stand 212 includes a connecting bracket 215 which may be supported at any one of a number of support points 216. In the illustrated embodiment, the support points 216 are holes positioned at regular intervals along the height of the stand 212. Each hole 216 is constructed and arranged to receive a pin inserted through a corresponding hole 217 in the connecting bracket. However, the support points 216 may be outwardly projecting members or any other type of structure capable of supporting the weight of the tracks 210 with the user positioned on them. In FIG. 9, a second angular position of the tracks 210 is drawn in phantom. Despite the difference in resistive systems, the foot support 206 functions in essentially the same way as shown in FIGS. 6A-6C.

The movable body support 204 is also connected to pull lines 56 which are trained over pulleys 58 carried by the frame assembly 202, such that the pull lines 56 may be pulled forwardly, towards the foot support 206, which movement moves the movable body support 204 in a direction away from the foot support 206. The ends of the pull lines 56 are provided with grips 70. As with the exerciser 10 of the previous embodiment, the user may use any combination of arm, leg, or arm and leg movements to move the movable body support, and the effects of both arm and leg movements are additive.

It will be noted that in both the horizontal exerciser of FIGS. 1-6C and the inclined exerciser of FIGS. 8-9, the main weight of the user is borne by the body support 14, 204. In its broadest aspect, the invention contemplates a vertical orientation of the body support 14, 204, in which case the body of the user P is supported on the body support 14, 204 to move with the body support 14, 204 without significant body weight support.

In the exercisers described above, the foot support 16 is a unitary structure that provides a single surface for contacting both of the user's feet. However, in other embodiments of the invention, individual foot supports, or individual contact areas, may be provided for each foot.

Figure 10:
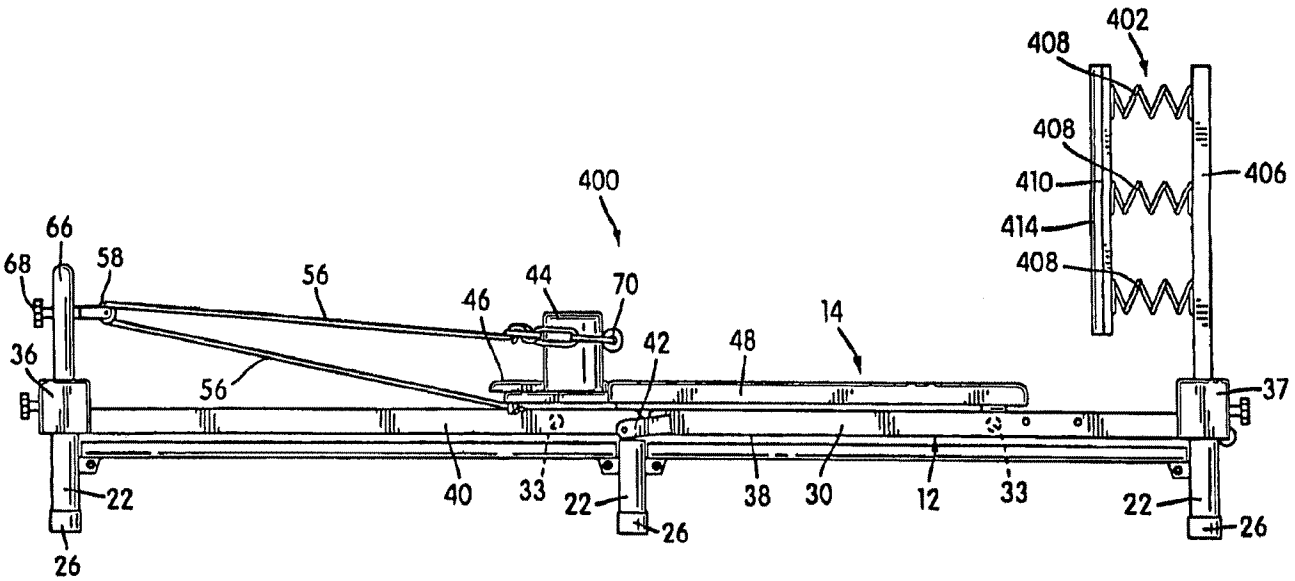
FIG. 10 is a side elevational view of an exerciser according to yet another embodiment of the invention.
Figure 12:
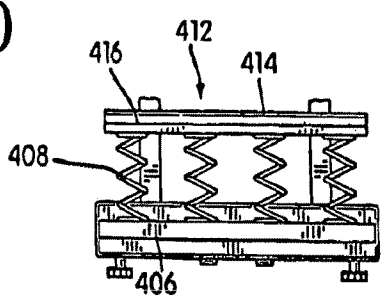
FIG. 12 is a top plan view of a foot support portion according to another embodiment of the invention, the exerciser itself being generally the same as that shown in FIG. 10.
Figure 11:
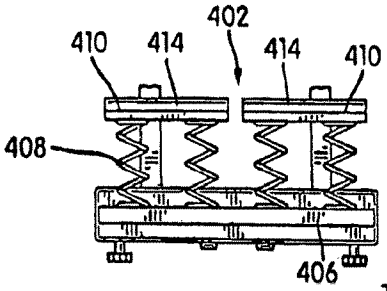
FIG. 11 is a top plan view of the foot support portion of the exerciser of FIG. 10.

An additional embodiment of the invention is shown in the side elevational view of FIG. 10. FIG. 10 illustrates an exerciser 400 having a foot support 402 that comprises two individual foot contact portions 410 connected to a vertically extending support 406 by compression springs 408. The foot contact portions 410 extend horizontally forward from the vertically extending support 406. FIG. 11 is a top plan view of the foot support 402 showing the two individual foot contact portions 410. Each foot contact portion 410 is sized to accommodate one of the user's feet. In another embodiment shown in the top plan view of FIG. 12, a foot support 412 includes a unitary foot contact portion 416 sized to accommodate both feet. In each case, the foot support 402, 412 would be provided with a layer of foam or other padding material 414 to provide comfort and traction for the user's feet. Those of skill in the art will note that the exercising motion enabled by the foot support 412 is similar to the exercising motion enabled by the foot support 16 described above. As will be apparent to those skilled in the art, the foot supports 402, 412 of FIGS. 10-12 may also be used as attachments to be installed on or retrofit to existing exercises apparatuses.

Further embodiments of the invention may combine attributes of the exercisers 10, 200, 400 described above. Moreover, some embodiments may add additional features and levels of user adaptability that are desirable in professional exercise settings, such as gyms and exercise studios.

The exercisers according to the present invention provide several advantages. First, the user can perform exercises in a supine or prone position, which is usually at least perceived by the user to be more comfortable. Second, the type of exercises that can be performed on exercisers according to the invention may have cardiovascular, strength, and flexibility benefits. Third, as was described above, certain known types of exercises, such as Pilates exercises, may be performed on exercisers according to the invention, if desired by the user.

Figure 13:
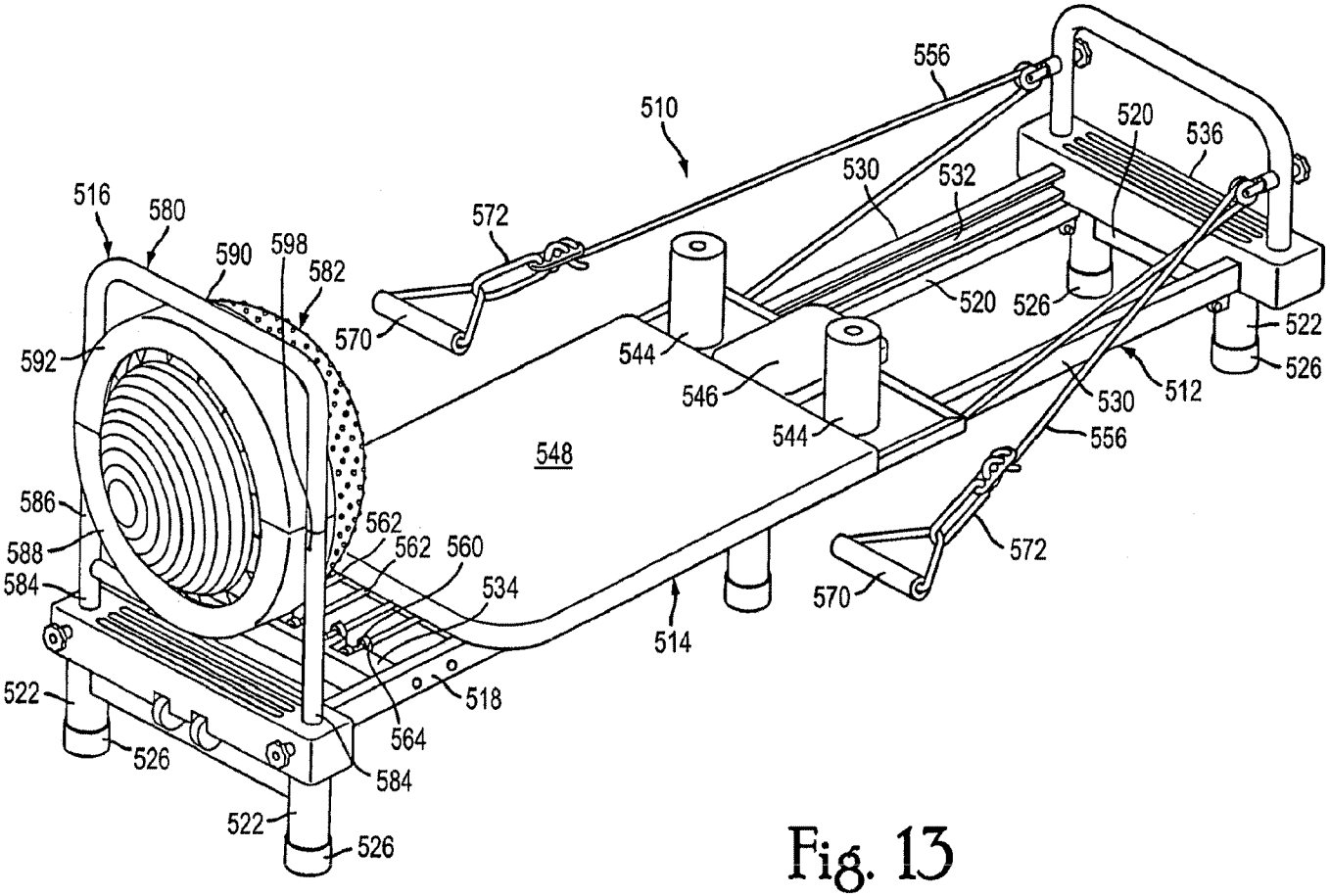
FIG. 13 is a perspective view of one embodiment of an exerciser constructed in accordance with the principles of the present invention.

FIG. 13 is a perspective view of an exerciser, generally indicated at 510, according to one embodiment of the invention. The exerciser 510 includes a mainframe assembly, generally indicated at 512, a movable body carriage or support, generally indicated at 514, disposed on the mainframe assembly 512 in a position to support the body of the user in a position enabling the feet of the user to be free from the movable body carriage 514, and a resiliently movable foot engaging assembly, generally indicated at 516, constructed and arranged to be mounted on the mainframe assembly 512 in a position to be engaged by the feet of the user supported on the movable body carriage 514.

Figure 14:
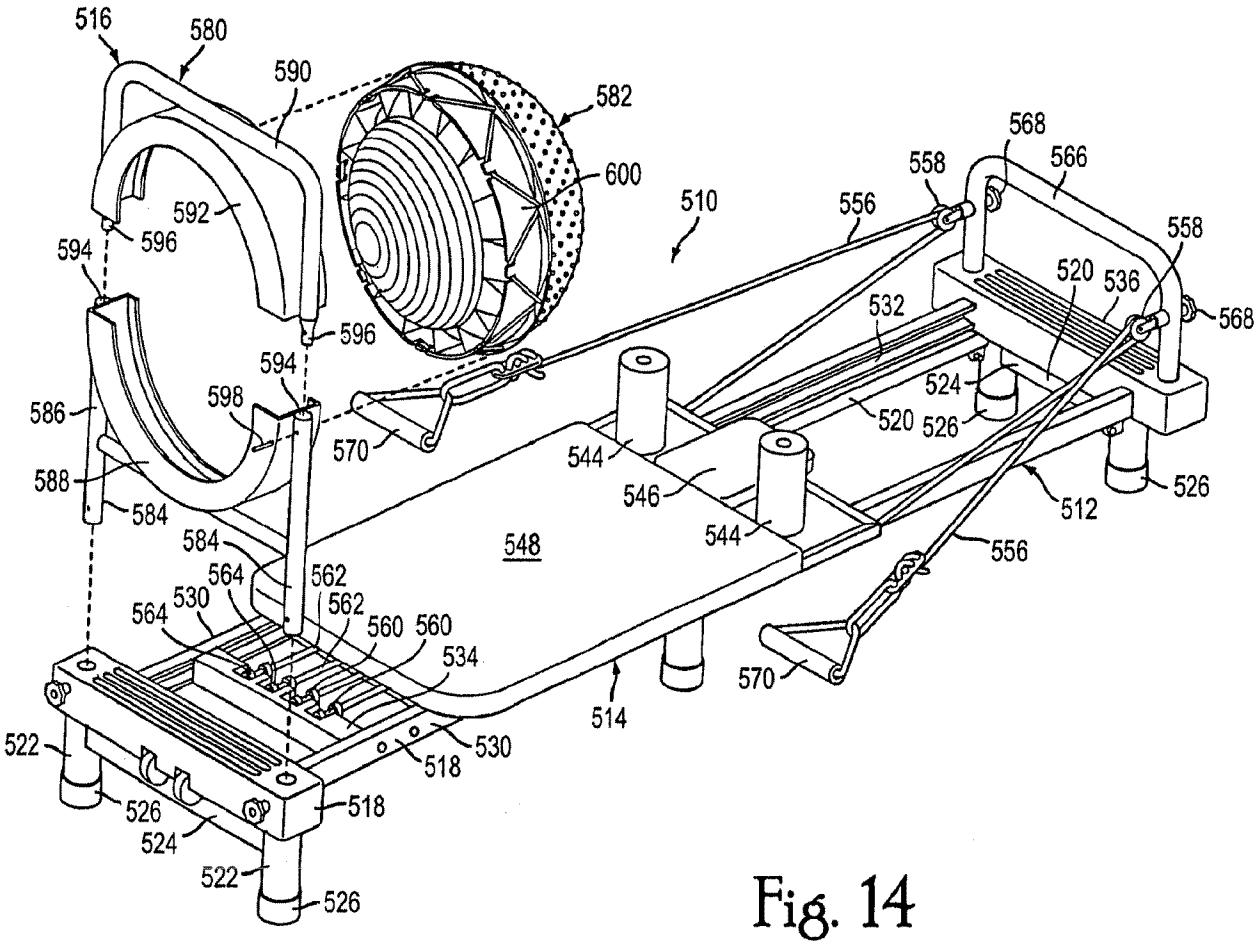
FIG. 14 is a view similar to FIG. 13 showing the foot engaging assembly of the present invention in exploded perspective.

The frame assembly 512 includes an upper frame structure 518, which is adapted to support the movable body carriage 14, the foot engaging assembly 516, and the user, on lower floor engaging stand 520. The stand 520 is adapted to connect to the frame structure 518 to hold the frame structure 518 in a generally horizontal plane above floor level. As is shown in FIGS. 13 and 14, the stand 520 comprises a plurality of legs 522 connected at respective upper ends thereof by cross bars 524, such that the stand portion 520 is comprised of generally rectangular or trapezoidal segments having legs 522 disposed at the corners of the segments. End caps 526 of a rubber or other non-skid material may be provided at floor-contacting ends of the legs 522. Upper receptacle sections of the stand 520 (not shown in the figures) are adapted to receive corresponding mating structures provided on the underside of the frame structure 518 (not shown in the figures), so as to operatively secure the frame structure 518 to the stand 520. The legs 522 of the stand 520 may be of any length that provides a convenient user height for the frame structure 518.

Depending on the embodiment, the frame structure 518 and stand 520 may be separable, so that the exerciser 510 can be stored easily. Additionally, the stand 520 may be omitted or sold separately, particularly if the height provided by the stand 520 is not required for the exercises that are to be performed. Moreover, it may be desirable to construct the stand 520 such that one end is wider than the other. A stand 520 with one wider end and one narrower end may be desirable if one end of the exerciser 510 requires a broader base of support to prevent lateral tipping, or if the exerciser 510 is constructed such that the stand 520 will only mate with the frame structure 518 if the frame structure 518 is in a particular orientation.

Figure 15:
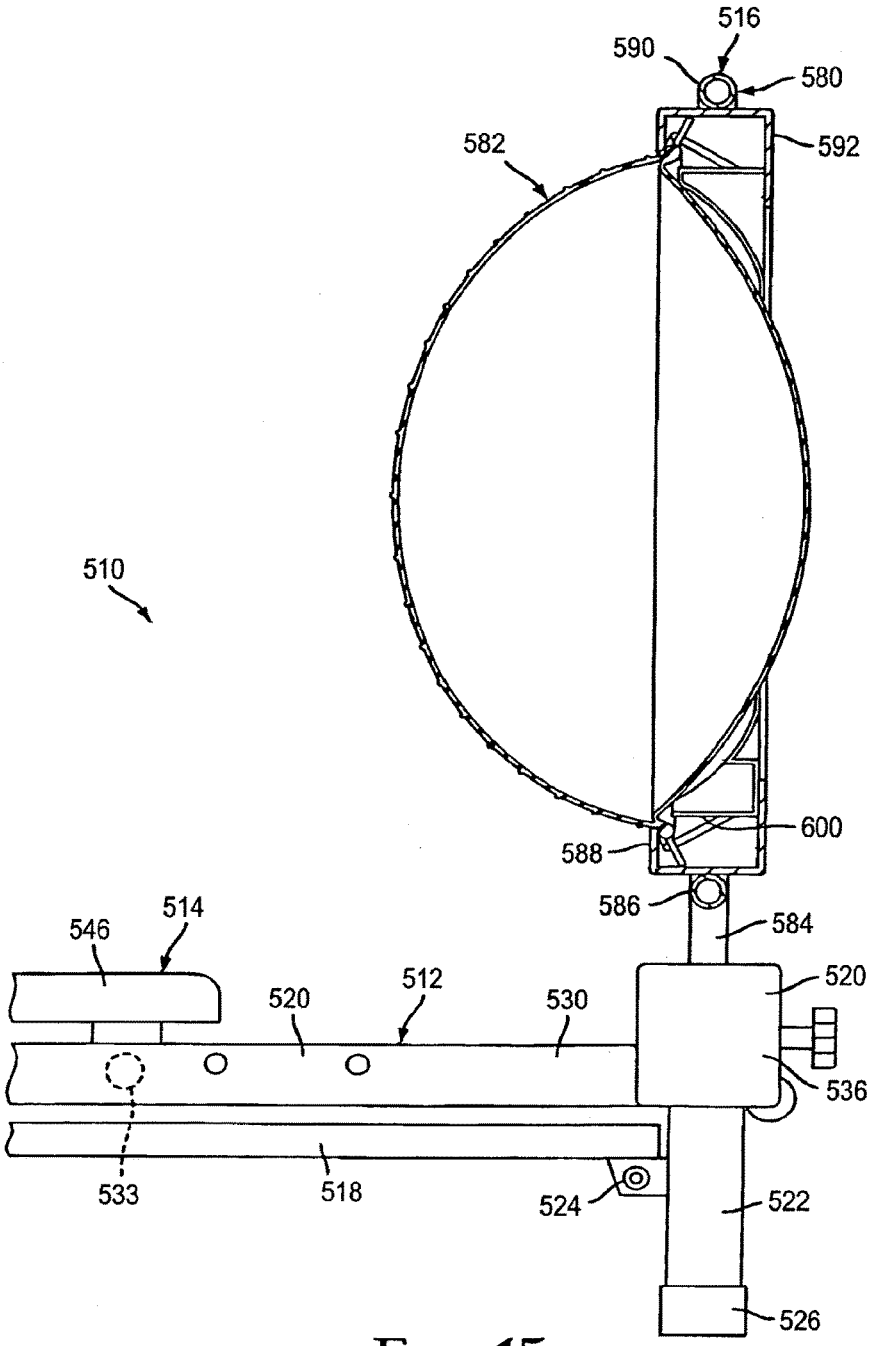
FIG. 15 is a fragmentary side elevational view of the foot end portion of the exerciser shown in FIG. 13 showing the foot engaging assembly in vertical section.
Figure 16:
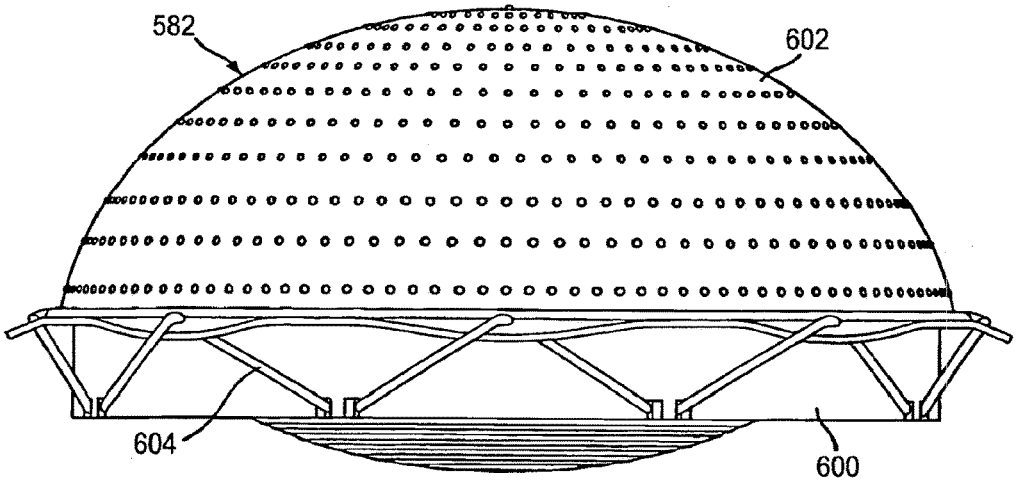
FIG. 16 is a side elevational view of the inflatable dome exercising unit forming a part of the foot engaging assembly.
Figure 17:
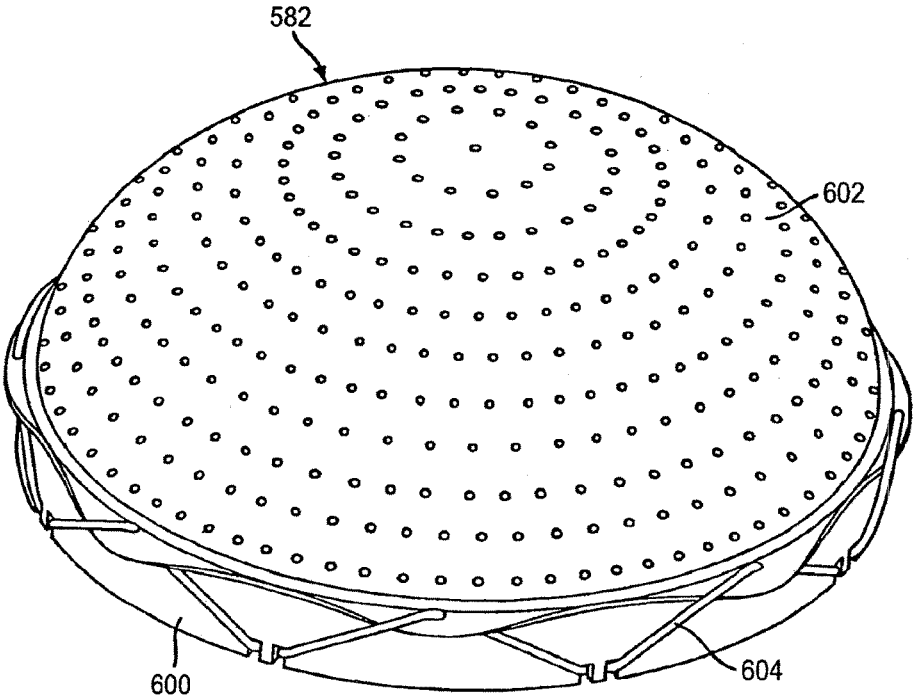
FIG. 17 is a perspective view of the unit shown in FIG. 16 deployed for use as an independently functioning floor supported exerciser.

The frame structure 518 may be comprised of two generally parallel support tracks 530, connected and braced by a number of cross members. In one embodiment, each of the support tracks 530 has a generally C-shaped cross-section, such that each support track 530 defines an interior track 532, in the shape of a channel, which is adapted to receive engaging portions of the movable body carriage 514. The engaging portions of the movable body carriage 514 in this embodiment are rollers 533 (shown in dotted lines in FIG. 15) that rollingly engage interior tracks 532. The rollers 533 are mounted to the underside of the movable body carriage 514 on appropriately-sized bearings or projections, and allow the movable body carriage 514 to roll along the support tracks 530 between limiting portions of the support tracks 530. The limiting portions of the support tracks 530 define the extent of travel for the movable body carriage 514. In the exerciser 510, one of the limiting portions is a crossbar 534 that extends between the two support tracks 530; the other limiting portion is defined by an endpiece 536 of the frame portion 518. Alternatively, the limiting portions may simply be the ends of the grooves 532 in the support tracks 530.

Although rollers 533 are used in the illustrated embodiment, a number of bearings and other movement support structures are known in the art, and any one of these known types of bearings may be used in place of the rollers. For example, instead of rollers, blocks of low-friction material may be used, and the inside tracks 532 in the support tracks 530 may be lubricated in order to facilitate sliding movement with reduced friction.

The support tracks 530 may be continuous bars that run the length of the exerciser, or they may be comprised of sets of shorter bars which may be hingedly connected together in a manner which allows the exerciser 510 to be folded when not in use.

In alternative embodiments of the invention, the support tracks may have a substantially rectangular cross-section, and a movable body carriage with rollers or other movement support structures may be configured so as to rest on top of the support tracks, rather than engaging inside tracks defined within them. The precise manner of engagement of the movable body carriage and the support tracks can take several different forms.

Several body engaging components may be mounted on the movable body carriage 514 so as to facilitate the body positioning of the user. Two padded shoulder blocks 544, one on each side of the body support 514, extend vertically, and are positioned so as to engage the upper portion of the user's torso (i.e., at the collarbone or shoulder region) when the user is lying prone or supine on the movable body carriage 514, so as to prevent the user from sliding relative to the movable body carriage 514 in a direction away from the foot engaging assembly 516. The shoulder blocks 544 may be removably attached to the movable body carriage 514, for example, by a threaded connection.

A padded head rest 546 can also be mounted on the movable body carriage 514. In the position illustrated in FIGS. 13 and 14, the head rest 546 is positioned such that its user-contacting surface is generally horizontal and co-planar with those of the movable body carriage 514. However, the head rest may be mounted on a multi-position bracket, such that its angular position may be adjusted relative to that of the movable body carriage so as to support the user's head in an inclined position. In addition to the head rest 546, torso pad 548 is mounted on the movable body carriage 514 so as to cover a substantial portion of the movable body carriage 514 to provide traction and comfort.

When the user is lying on the movable body carriage 514 in either prone or supine position with his or her head on the head rest, the user's feet are free to move with respect to the movable body carriage 514, and extend in a direction toward the resilient foot engaging assembly 516.

The exerciser 510 may also carry a resilient resistance system coupled to the movable body carriage 514. The crossbar 534 at the footend has several slots 560 formed in it. Each slot 560 in the crossbar 534 is sized and adapted to accept one end of a tensile resilient resistance element 562. A bracket on the underside of the movable body carriage 514 (not shown in the figures) includes a corresponding set of slots 560, each slot 560 adapted to accept the other end of a tensile resilient resistance element 562. In this embodiment, the crossbar 534 and bracket of the movable body carriage 514 each include four slots 560; however, the number of slots 560 may be selected arbitrarily, depending on the total desired resistance, the width of the crossbar 534 and bracket, and the total amount of space required for each resilient resistance element 562. The exerciser 510 may be operated with any number of resilient resistance elements 562 installed in the slots.

The tensile resilient resistance elements 562 illustrated in FIGS. 13 and 14 are elastomeric cords ("bungee cords") with knobs 564 installed at the ends, so that the ends may be seated in the slots 560 provided for them. The tensile resilient resistance elements 562 may also comprise tension coil springs, rubber bands, or similar structures. Depending on the type of resilient resistance elements 562, hooks or other receiving structures may be used instead of slots. As those of skill in the art will appreciate, one of the functions of the tensile resilient resistance elements 562 is to bias the movable body carriage 514 to return to a position proximate to the movable foot support 516 by virtue of the energy stored when moved away from the resilient foot engaging assembly 516.

The exerciser 510 of FIG. 13 also carries an arm exercise system. Two pull lines 556 are connected to the underside of the movable body carriage 514. From the underside of the movable body carriage 514, the pull lines 556 are trained over pulleys 558 that are carried by an upright bar 566 provided on the head end of the exerciser 510 opposite the foot end. The pulleys 558 are adapted to swivel, so as to allow the user to pull the pull lines 556 toward the resilient foot engaging assembly 516 in a variety of planes of motion. They pulleys 558 are also releasably mounted on the upright bar 566 by mounting structure 568 so that their angle and orientation can be changed by the user.

From the pulleys 558, the pull lines 556 extend towards the resilient foot engaging assembly 516, and are coupled to user grips 570 at their ends. Between the ends of the pull lines 556 and the user grips 570, take-up fittings 572 are provided. Each take-up fitting has a number of holes 574 formed in it, such that if the pull lines are too long, they may be wrapped around and through the take-up fittings 572 to reduce their effective lengths. When the user grips the user grips 570 and causes the pull lines 558 to extend, he or she is working against the force bias provided by the tensile resilient resistance elements 562. The arm exercise system, including the pull lines 556, pulleys 558 and associated structures is an optional feature, and may not be included in some embodiments of the invention.

In the embodiment shown in FIGS. 13-17, the resilient foot engaging assembly 516 comprises a unit frame assembly, generally indicated at 580, constructed and arranged to be mounted on the pilates exerciser 510 in lieu of the normal inverted U-shaped foot bar thereof, and a resilient foot engaging unit, generally indicated at 582, constructed and arranged to be deployed by itself as an independently functioning exerciser. As previously indicated, the unit frame assembly 580 is constructed and arranged to be mounted on the pilates exerciser 510 in lieu of the normal inverted U-shaped foot bar thereof. To this end, the unit frame assembly 580 includes a pair of traversely-spaced depending tubular mounting elements 584 configured to securely engage within the sockets within which the normal inverted U-shaped foot bar is engaged.

The unit frame assembly 580 is also constructed and arranged to selectively (1) embody the resilient foot engaging unit 582 in the pilates exerciser 510 so as to provide the user with the exercising movements hereinafter described with respect to the exerciser 510, and (2) releasing the resilient foot engaging unit 582 for use as an independent exerciser by itself so as to provide the user with the different exercising movements attributable to the unit 582 per se. To this end, the unit frame assembly 580 includes a lower frame section 586 which embodies therein the depending mounting elements 584 and an upwardly facing semi-circular unit mounting member 88 of upwardly opening U-shaped cross-sectional configuration.

The unit frame assembly 580 also includes a separate upper frame section 590 which provides a downwardly mating upper unit mounting member 592 of mating U-shaped cross-sectional configuration.

The separate upper frame section 590 is constructed and arranged to be releasably secured in mating relation to the lower frame section 586 by any suitable means. As shown, the lower frame section 586 provides two transversely-spaced upwardly opening sockets 594 configured to securely receive therein a pair of transversely-spaced tube ends 596 depending from the upper frame section 590 on opposite sides of the upper unit mounting member 592. Removable pins 598, insertable through the sockets 594 and tube ends 596, serve to detachably secure the upper frame section 590 to the lower frame section 586 so that the upper and lower mating unit mounting members 592 and 588 form a complete circular mounting structure for the unit 582.

The unit 582, as shown in FIGS. 13-17, may include structures and features as disclosed in U.S. Pat. No. 6,702,726 ("the '726 patent"), hereby incorporated by reference in its entirety. The details of the construction taught in the '726 patent can be understood by reference to the disclosure of that patent. For present purposes, it is sufficient to note that the unit 582 includes a peripheral frame 600 constructed and arranged to be stably supported on a horizontal floor surface and an inflated dome forming bladder 602 fixedly secured on the peripheral frame 600, by interlaced elongated flexible elements 604, so as to provide an upwardly facing resilient dome to be engaged by the feet and other portions of the users' body when the peripheral frame 600 is mounted on a floor surface. The various exercising movements provided by the floor mounted unit 582 are fully disclosed in the aforesaid '726 patent to which reference can be made. For present purposes, it is sufficient to note that these exercising movements are different from those provided when the unit 582 is mounted on the pilates exerciser 510 by the unit frame assembly 580.

As can be appreciated from the above description, mounting is accomplished by first fitting the upper and lower unit mounting members 592 and 588 around the peripheral frame 600 so that the peripheral frame 600 is seated within the U-shaped cross-sectional configurations of the members 592 and 588 and then inserting removable pins 598. With the unit 582 thus secured to the unit frame assembly 580, the mounting elements 584 of the latter can now be mounted in the sockets normally provided for the inverted U-shaped foot bar of the pilates exerciser 510.

The resilient foot engaging assembly 516 is constructed and adapted to yield in a controlled manner in response to the engagement of the user's feet therewith in a direction toward the foot assembly 516 and to establish, as a result of the controlled yielding, a bouncing movement by the foot assembly 516 in the opposite direction, which can be translated by the user into a movement of the movable body carriage 514 in that opposite direction. In this context, the term "bouncing movement" may refer to movements during which the feet of the user lose contact with the foot assembly 516, as well as resilient movements during which the feet of the user remain in contact with the foot assembly 516. The term "feet" may refer to both of the user's feet together or to one individual foot; the exercises shown described here may be performed with one foot, each foot alternately, or both feet simultaneously. The terms "controlled yielding" and "resilient yielding" imply that the foot assembly 516 or individual foot portions thereof yield in such a manner that they are biased to return to their original position.

By the operation of the resilient resistance system, the movable body carriage 514 is constructed and arranged to absorb the energy of movement of the user on the movable body carriage 514 in a direction away from the foot assembly 516 and to convert that absorbed energy into a movement toward the foot assembly 516.

The user may control the degree of resistive bias by changing the number of tensile resistive elements 562 that are connected between the crossbar 534 and the movable body carriage 514. The pull lines 556 are constructed and arranged such that forces applied in a direction toward the foot support 516 by the user's arms are converted into movements of the movable body carriage 514 away from the foot assembly 516. Alternatively, the user may control the position of the movable body carriage 514 solely by flexure of the legs against the foot assembly 516.

In one exemplary type of exercise that may be performed with the exerciser 510, the user lies on the movable body carriage 514 in an essentially supine position, flexed at the knees, with the bottoms of his or her feet in contact with the dome provided by the inflated bladder 602 of the foot assembly 516. The user may also grip the user grips 570, and extend the pull lines 556 forwardly. As the user moves the movable body carriage 514 towards the foot assembly 516, the dome-shaped bladder 602 is caused to deflect. The resiliency of the inflated bladder 602 caused the dome-shaped bladder 602 to rebound, creating a bouncing movement by the foot assembly 516 that the user can translate into a movement of the movable body carriage 514. The actual amount of bouncing or resiliency will vary with the inflation pressure of the bladder 602, as well as the way in which the user controls the movement.

Other exercising movements that can be performed on the exerciser 510 equipped with the inflatable bladder 602 are the same as those disclosed in the '433 application to which reference may be had.

Figure 18:
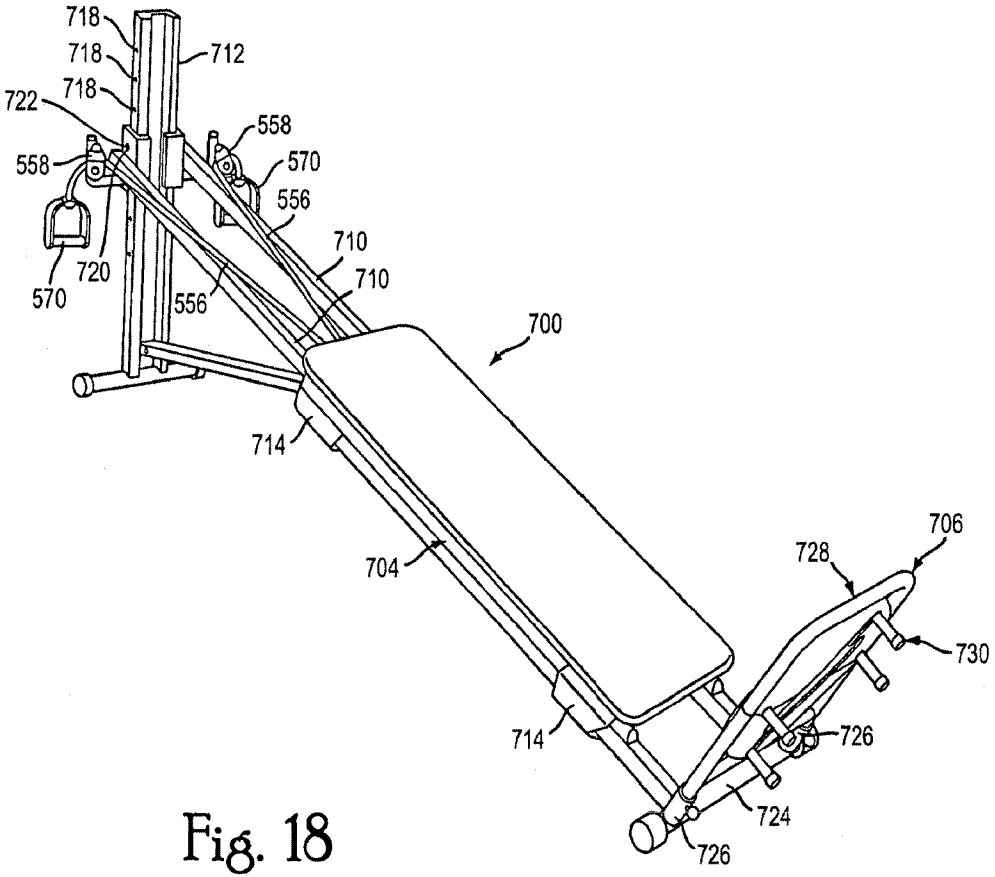
FIG. 18 is a perspective view of another embodiment of an exerciser constructed in accordance with the principles of the present invention.
Figure 19:
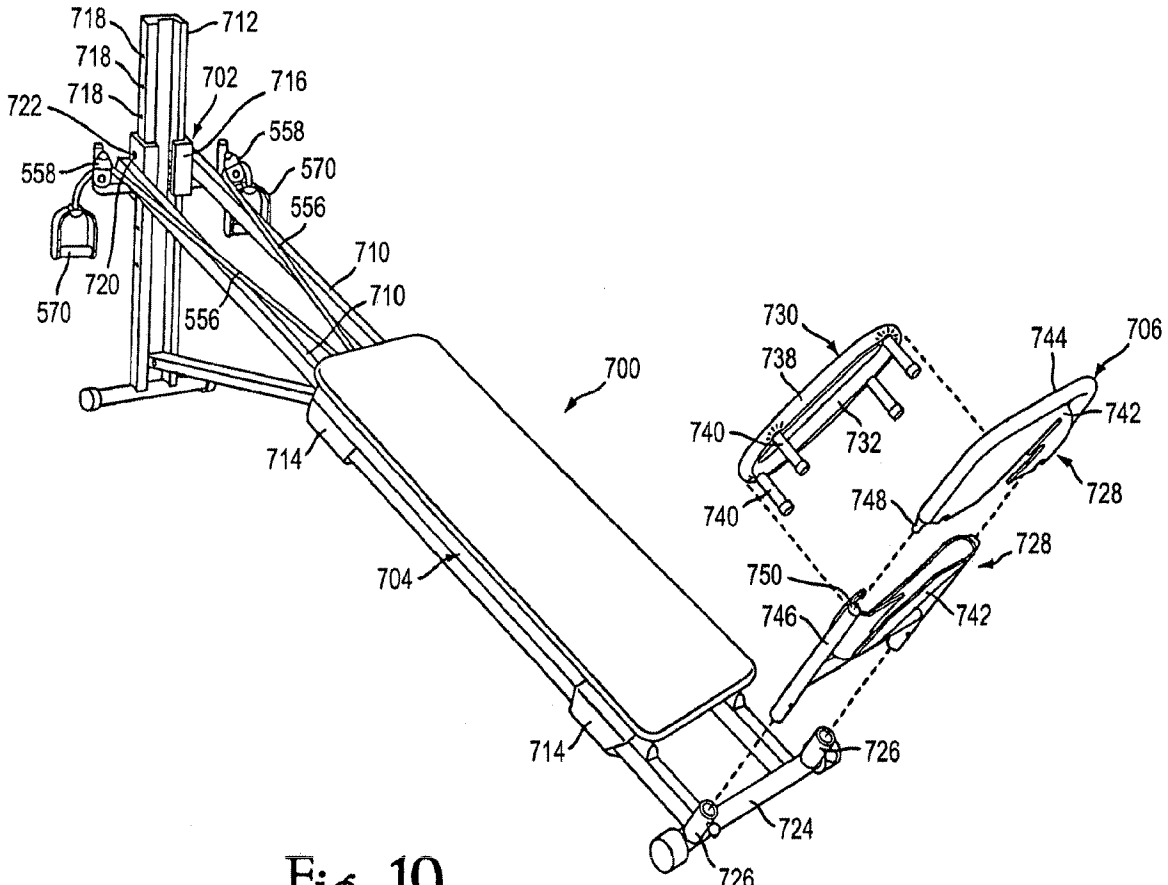
FIG. 19 is a view similar to FIG. 18 showing the foot engaging assembly of the present invention in exploded perspective.

An exerciser 700 according to another embodiment of the invention is shown in the perspective view of FIG. 18. The exerciser 700 may incorporate all or some of the structures and features disclosed in U.S. Pat. No. 5,967,955, which was incorporated by reference above.

In general, the exerciser 700 includes a frame assembly, generally indicated at 702, a movable body carriage or support, generally indicated at 704, mounted on the frame assembly 702 for movement between limiting positions on the frame assembly 702, and a resilient foot engaging assembly, generally indicated at 706.

In one embodiment, the exerciser 700 does not include a resilient resistance system; instead, the frame assembly 702 includes two generally parallel support tracks 710, which are supported on an inclined plane by a stand 712. With this arrangement, the movable body carriage 704 is mounted for movement along the inclined plane defined by the tracks 710. The tracks 710 of the exerciser 700 of this embodiment do not include interior tracks; instead, the movable body carriage 704 is supported by four roller assemblies 714 which roll along the upper surface of the tracks 710.

As supported by the stand 712 on the inclined plane, the movable body carriage 704 absorbs the energy of movement of a user supported thereon moving along the tracks 710 up the inclined plane because the user is working against the influence of gravity, and is thus storing potential energy. The movable body carriage 704 converts the absorbed energy into a movement along the tracks 710 down the inclined plane because the absorbed/stored potential energy is converted by gravity to kinetic energy.

In other words, the user is working against all or a portion of his or her own body weight, which provides the user with exercising resistance. The amount of exercising resistance may be varied by varying the incline of the tracks 710. As shown, the stand 712 includes a connecting bracket 716 which may be supported at any one of a number of support points 718. In the illustrated embodiment, the support points 718 are holes positioned at regular intervals along the height of the stand 712. Each support point hole 718 is constructed and arranged to receive a removable pin 720 inserted through a corresponding hole 722 in the connecting bracket 716. However, the support points may be outwardly projecting members or any other type of structure capable of supporting the weight of the tracks 710 with the user positioned on them. Despite the difference in resistive systems and the resilient foot engaging assembly 706 as hereinafter described, the exerciser 700 functions in essentially the same way as previously described in the description of the exerciser 510.

The movable body carriage 704 may also be connected to pull lines 556 which are trained over pulleys 558 carried by the frame assembly 702, such that the pull lines 556 may be pulled forwardly, towards the resilient foot engaging assembly 706, which movement moves the movable body carriage 704 in a direction away from the resilient foot engaging assembly 706. The ends of the pull lines 556 are provided with grips 570. As with the exerciser 510 of the previous embodiment, the user may use any combination of arm, leg, or arm and leg movements to move the movable body carriage, and the effects of both arm and leg movements are additive.

The exerciser frame assembly 702 includes an end member 724 having a pair of transversely-spaced tubular sockets 726 fixed on opposite ends thereof. The sockets 726 can receive an inverted U-shaped foot bar of the type embodied in a usual pilates exerciser. As with the exerciser 510, the usual inverted U-shaped foot bar becomes one attachment that can be used instead of the resilient foot engaging assembly 706. The resilient inflated dome foot engaging assembly 516 of the exerciser 510 can also be fitted as an attachment to the exerciser 700, as well as the exerciser 510.

Figure 20:
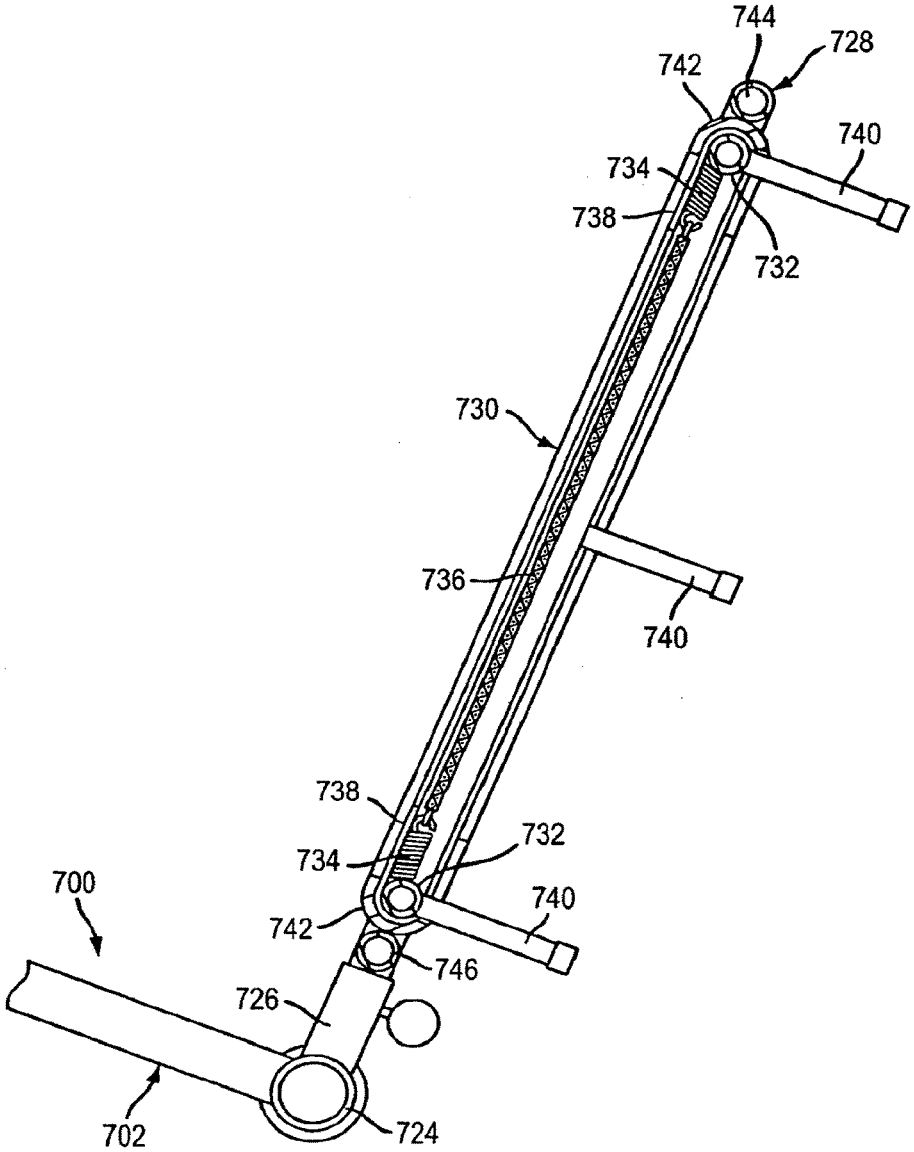
FIG. 20 is a fragmentary side elevational view of the foot end portion of the exerciser shown in FIG. 13 showing the foot engaging assembly in vertical section.
Figure 21:
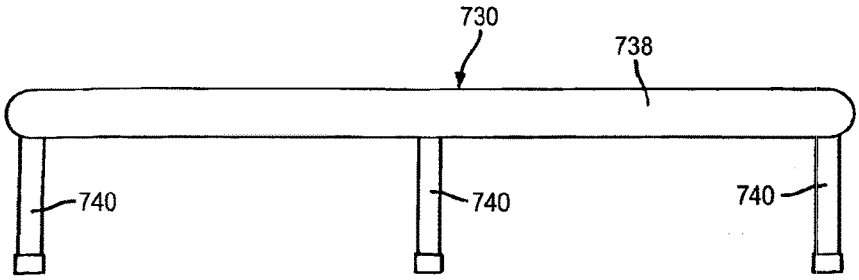
FIG. 21 is a side elevational view of the trampoline exercising unit forming a part of the foot engaging assembly.
Figure 22:
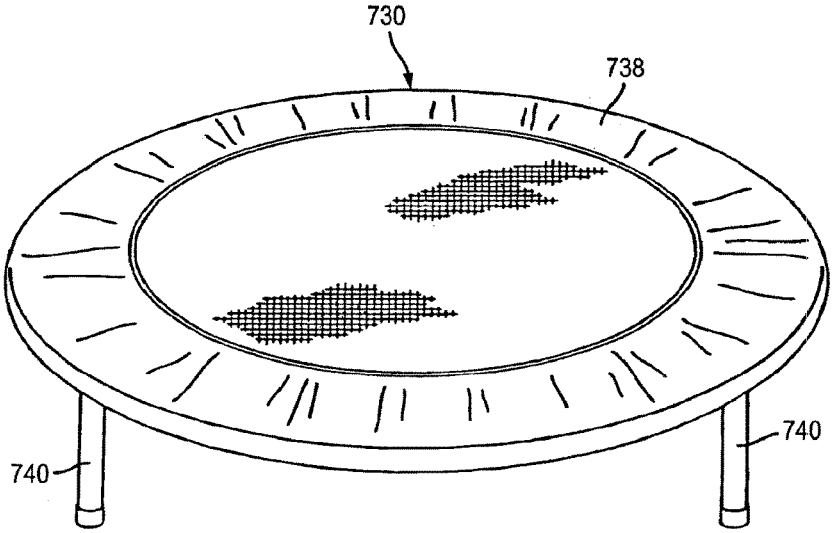
FIG. 22 is a perspective view of the unit shown in FIG. 16 deployed for use as an independently functioning floor supported exercising unit.

As shown in FIGS. 20-22, the resilient foot engaging assembly 706, is similar to the resilient foot engaging assembly 516 in that it is comprised of a unit frame assembly, generally indicated at 728, and resilient foot engaging unit, generally indicated at 730.

The foot engaging unit 730, in one embodiment, is a circular floor engaging trampoline unit sized for individual use. Briefly, the unit 730 includes a circular tubular frame 732 which is apertured along its interior periphery to enable outer hooked ends of a series of annularly-spaced coil springs 734 (see FIG. 20) to be anchored thereto. The coil springs 734 extend radially inwardly from the circular frame 732 and have inner ends hooked and anchored to the outer periphery of a flexible circular sheet member 736. A resilient circular cover 738 of J-shaped cross-sectional configuration is extended in covering relation over the circular frame 732 and coil springs 734. A series (4) of legs 740 are fixed to the circular frame 732 and extend axially therefrom in one direction.

The trampoline unit 730 can be used by an individual with the unit 730 supported by the legs 740 on a horizontal floor surface. It, like the inflated dome unit 582, is resiliently deformably engageable by one or both feet on other body parts of the user and capable of bouncingly returning the deformation movement.

The unit frame assembly 728 is similar to the unit frame assembly 582 except that it is configured to accommodate the different trampoline unit 730. The unit frame assembly 728 includes a similar pair of upper and lower cooperating mounting elements 742, and similar upper and lower frame sections 744 and 746 releasably interconnected by tube ends 748 fitted and pinned in sockets 750. The upper and lower frame sections 744 and 746 carry upper and lower unit mounting members 752 and 754 which are configured differently to accommodate the different frame and leg configuration of the trampoline unit 730.

In one embodiment of FIGS. 13-22, it should be appreciated that the unit frame assemblies may be integrally formed with the associated resilient foot engaging assemblies (e.g., inflated bladder unit, trampoline unit, etc.) so that they are removable together from the Pilates unit. In fact, the structure for mounting any one of the resilient foot engaging assemblies can be any structure that enables the resilient foot engaging assembly to be releasably fixed relative to the main frame and/or tracks on which the movable body support or carriage is supported.

Figure 23:
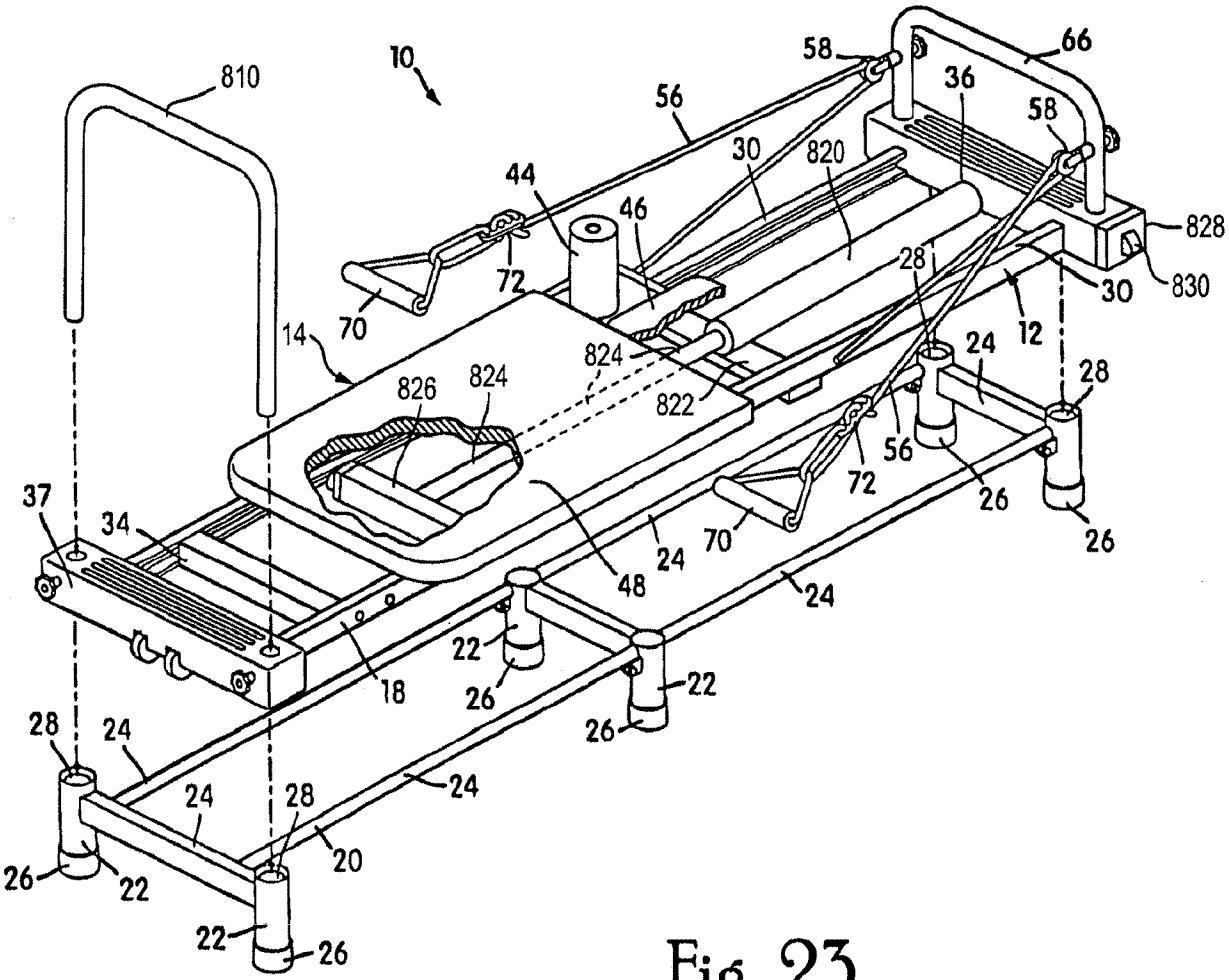
FIG. 23 is a view similar to FIG. 2 showing another carriage movement and return system, shown with a conventional inverted U-shaped foot engaging unit in lieu of the trampoline unit shown in FIG. 2, with parts broken away for purposes of clearer illustration.

FIG. 23 illustrates another embodiment of the present invention which may utilize a conventional inverted, rigid U-shaped bar 810 serving as the foot engaging unit rather than the trampoline type unit 16 of FIG. 2. It should be appreciated that either the U-shaped bar 810, the trampoline unit 16 or any other foot engaging structure disclosed herein (e.g., 206, 402, 412, 516, 706, 730, etc.), can be used for the foot engaging structure in this embodiment. The foot engaging structure (e.g., 810 or 16) can be permanently fixed as part of the exerciser 10, or can be interchangeable with one another or with the other foot engaging structures disclosed herein. In FIG. 23, reference numbers shown that also appear in FIG. 2 are of like construction and need not be discussed in particular detail again here. The embodiment of FIG. 23 relates to the use of an electromechanical system, and in one embodiment, an electromagnetic system, for returning the movable body carriage 14, back towards the foot engaging structure, in lieu of the bungee cords 62 shown in FIG. 2 or the inclined gravity return arrangement of FIG. 8.

As shown, an elongated solenoid coil unit 820 has one end thereof fixed to the central portion of the cross member 36 at a level between the tracks 30. The solenoid coil unit 820 extends longitudinally away from the cross member 36 and has its opposite end fixed to the frame 12 as by a cross brace member 822 fixed to the undersides of the track or rails 30 and extending thereacross. A solenoid plunger member 824 has a free end portion thereof slidably mounted for linear movement through the solenoid coil unit 820 and an opposite end fixed to move with the body carriage 14. For example, the opposite end of plunger 824 may be fixed to a cross brace member 826, fixed to the bottom of carriage 14 and extending between the roller brackets 829 fixed in depending relation at the foot end of the carriage 14.

The coil of the solenoid coil unit 820 is electronically connected to a battery or A/C powered central circuit, shown schematically at 828 in FIG. 23. The control circuit 828 includes a manually adjustable input dial 830, which can be turned to adjust the resistance of the circuit connected with the solenoid coil 820 and hence the amount of current traveling through the solenoid coils. The amount of current through the coils of the solenoid coil unit 820 will dictate the amount of force applied to the plunger 824 for driving the plunger 824 and carriage 14 towards the foot engaging structure.

The solenoid coil unit 820 and solenoid plunger 824 operate like a conventional solenoid assembly. The plunger 824 is made from a material sensitive to the magnetic force generated by coil unit 820. Energization of the coil of the solenoid coil unit 820 biases the solenoid plunger 824 in a direction longitudinally outward of the solenoid coil unit 820. In the embodiment shown, the solenoid plunger 824 extends outwardly of the solenoid coil unit 820 a maximum amount when the coil is energized and the body carriage 14 is not in use, as shown in FIG. 23. The electrical field created by the energization of the coil of the solenoid coil unit 820 provides a resistance to the movement of the solenoid plunger 824 inwardly into coil unit 820 which, in turn, creates a bias or force that moves the body carriage 14 connected to plunger 824 in a direction away from cross member 36 and toward the foot engaging support, while also generating a resistance to the movement away from the foot engaging support 16 or 810 when the user drives the body carriage 14 away from the foot engaging support during exercise.

As can be appreciated from the discussion above, the bias toward foot support and resistance away from the foot support is a function of the amount of electrical power transmitted to the coil of the solenoid coil unit 820 and hence the amount of bias toward and resistance away from can be easily controlled by manual movement of the dial 830. The control circuit 828 can also include a computer control in accordance with known practices.

In essence the solenoid coil unit 820 and solenoid plunger 824 arrangement as described above is another way of biasing the carriage 14, as in contrast with the manner of biasing achieved by the bias of the bungee cord 62 and by the inclined gravity bias, for example. Consequently, this feature of the present invention is useful with resilient type foot engaging units disclosed, as well as with a conventional inverted, rigid U-shaped foot bar 810 shown. In another embodiment, the solenoid coil and plunger arrangement 820/824 can be used in addition to the bungee cord and/or gravitation (inclined) return, thus giving the user various alternatives or combined (working in concert) return mechanisms.

While FIG. 23 and the description above has the solenoid coil unit 820 fixed and the solenoid plunger 824 moving, it is within the contemplation of the present invention to fix the solenoid plunger to frame 12 and move the solenoid coil unit with the carriage 14.

Other electromechanical systems include the provision of an electric motor driving the pinion of a rack and pinion gear system mounted between the carriage 14 and frame 12. A control circuit is provided for the electric motor which controls the electricity supplied to the coils of the motor defining the flux field. When energized in one direction, the electric motor is driven as an electric motor biasing the carriage 14 to move toward the foot engaging unit and when the energization is changed, resistance to the movement in the opposite direction away from the foot engaging unit can be accomplished.

Bi-directional electrical motors operating in two directions are a well known way of providing variable resistance to the movement of the exercising apparatus. By varying the electric power transmitted to the flux coils, variability can be easily achieved electrically. For example, the reverse operated electric motor can be connected directly to one of the rollers of a treadmill or the crank member of an elliptical exerciser. It is within the contemplation of the present invention to provide variability with the use of a reverse operated electric motor connected to a pinion of a rack and pinion gear system between the frame 12 and carriage 14, rather than connecting and disconnecting bungee cords or changing the height of the inclination of the frame.

The present invention is not limited to the above disclosure, but also includes all subject matter covered by the following claims and equivalents thereof.

What is claimed:

1. An exercise device comprising:

a frame including a track;

a body support mounted for movement on the track;

a foot support disposed towards one end of the track, the foot support comprising a fabric flexible sheet supported by a sheet support frame, the sheet support frame comprising laterally spaced portions, the fabric flexible sheet extending over an area between the laterally spaced portions such that the fabric flexible sheet is restrained in tension by the sheet support frame; and tensile resilient elements that bias the body support toward the flexible fabric sheet, wherein the fabric flexible sheet supported by the sheet support frame is oriented relative to the track so as to be engaged by a user's feet moving towards the flexible fabric sheet as a result of the bias during exercise.

2. The exercise device of claim 1, wherein the sheet support frame comprises a peripheral frame.

3. The exercise device of claim 2, wherein the peripheral frame surrounds all sides of the fabric flexible sheet.

4. The exercise device of claim 2, wherein the peripheral frame comprises a closed loop.

5. The exercise device of claim 2, wherein the peripheral frame comprises a cross member, two side members, and two connecting shaft portions extending generally perpendicular to the cross member and generally parallel to the side members.

6. The exercise device of claim 2, wherein the peripheral frame is configured to attach to all edges of the fabric flexible sheet.

7. The exercise device of claim 1, wherein the fabric flexible sheet is connected to the laterally spaced portions.

8. The exercise device of claim 7, wherein the sheet support frame further comprises a cross member joining the laterally spaced portions.

9. The exercise device of claim 1, wherein the body support is mounted for movement relative to the track along an inclined direction.

10. The exercise device of claim 9, wherein an extent of inclination of the inclined direction is user-adjustable to enable the user to adjust an amount of gravity-based exercising resistance.

11. The exercise device of claim 1, wherein the fabric flexible sheet is resiliently connected to the sheet support frame.

12. The exercise device of claim 1, wherein the frame is configured to position the track in an inclined position so that the force of gravity biases the body support along the track toward the foot support.

13. The exercise device of claim 1, wherein the fabric flexible sheet is made from a resilient material.

14. The exercise device of claim 1, further comprising a headrest to support a head of the user, the headrest being mounted for movement with the body support relative to the track.

15. The exercise device of claim 1, further comprising a padded shoulder block mounted for movement with the body support relative to the track.

16. The exercise device of claim 1, wherein the body support is shaped and configured to support the user when the user lies on the body support during use of the exercise device.

17. The exercise device of claim 1, further comprising a torso pad mounted for movement with the body support relative to the track, the torso pad being shaped and configured to provide traction and comfort to the user when the user lies on the movable body support during use of the exercise device.

18. The exercise device of claim 1, wherein the body support is mounted for movement relative to the track along a horizontal direction.

19. The exercise device of claim 1, wherein the tensile resilient elements are oriented in a tensile direction that extends along a direction of movement of the body support relative to the track.

20. The exercise device of claim 1, wherein the tensile resilient elements are configured to bias the body support to return to a position proximate to the foot support.

21. The exercise device of claim 1, wherein the body support is mounted for movement relative to the track along a fixed path.

22. The exercise device of claim 1, wherein the sheet support frame comprises an upside-down "U" shape in which the laterally spaced portions of the sheet support frame define laterally spaced sides of the "U" shape.

23. The exercise device of claim 1, wherein the fabric flexible sheet is oriented in a direction perpendicular to a direction of movement of the body support relative to the track.

24. The exercise device of claim 1, wherein the sheet support frame is oriented in a direction perpendicular to a direction of movement of the body support relative to the track.

25. An exercise device comprising:

a frame including an inclined track;

a body support mounted for movement on the inclined track; and a foot support disposed towards one end of the inclined track, the foot support comprising a fabric flexible sheet supported by a sheet support frame, the body support being biased by gravity towards the fabric flexible sheet, the sheet support frame comprising laterally spaced portions, the fabric flexible sheet extending over an area between the laterally spaced portions such that the fabric flexible sheet is restrained in tension by the sheet support frame, wherein the fabric flexible sheet supported by the sheet support frame is oriented relative to the inclined track so as to be engaged by a user's feet moving towards the flexible fabric sheet as a result of the bias during exercise.

* * * * *